US005397688A

United States Patent [19]

Yoshioka

[11] Patent Number: 5,397,688

[45] Date of Patent: Mar. 14, 1995

[54] SILVER HALIDE COLOR LIGHT-SENSITIVE MATERIAL

[75] Inventor: Yasuhiro Yoshioka, Minami-Ashigara, Japan

[73] Assignee: Fuji Photo Film Co., Ltd., Kanagawa, Japan

[21] Appl. No.: 64,796

[22] Filed: May 21, 1993

Related U.S. Application Data

[63] Continuation of Ser. No. 850,936, Mar. 13, 1992, abandoned.

[30] Foreign Application Priority Data

Mar. 13, 1991 [JP] Japan ..... 3-072111

[51] Int. Cl.[6] ..... G03C 1/46

[52] U.S. Cl. ..... 430/503; 430/557; 430/546; 430/551; 430/545

[58] Field of Search ..... 430/503, 557, 545, 546, 430/957, 551

[56] References Cited

U.S. PATENT DOCUMENTS

| | | | |
|---|---|---|---|
| 4,248,961 | 2/1981 | Hagen et al. | 430/381 |
| 4,289,847 | 9/1981 | Ishikawa et al. | 430/389 |
| 5,006,453 | 4/1991 | Takahashi et al. | 430/546 |
| 5,100,771 | 3/1992 | Mihayashi et al. | 430/546 |

OTHER PUBLICATIONS

Weissberger, et al. *Yellow Color Formers for Color Development* 1962, *Chemical Abstracts*, vol. 57, #2373.

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

In a multilayered silver halide color light-sensitive sensitive material having a yellow dye forming silver halide emulsion layer, a magenta dye forming silver halide emulsion layer, and a cyan dye forming silver halide emulsion layer on a support, at least one type of an acylacetamide-based yellow coupler in which the acyl group in the acylacetamide is represented by formula (I) below and at least one type of a water-insoluble polymer are contained in the yellow dye forming layer, In formula (I), $R_1$ represents a monovalent group, and Q represents a nonmetallic atom group required to form, together with C, a 3- to 5-membered hydrocarbon ring or a 3- to 5-membered heterocyclic ring having at least one hereto atom selected from N, S, O, and P in the ring, $R_1$ is not a hydrogen atom and is not combined with Q to form a ring:

Formula (I)

21 Claims, No Drawings

SILVER HALIDE COLOR LIGHT-SENSITIVE MATERIAL

This application is a continuation of application Ser. No. 07/850,936, filed on Mar. 13, 1992, now abandoned.

BACKGROUND OF THE INVENTION

1. Field of the Invention

The present invention relates to a silver halide color light-sensitive material containing a novel acylacetamide-based yellow dye forming coupler and, more particularly, to a silver halide color light-sensitive material in which color turbidity in a yellow color formed region is reduced.

2. Description of the Related Art

In a silver halide color photographic light-sensitive material, the oxidized form of an aromatic primary amine developing agent and dye forming couplers (to be referred to as couplers hereinafter) react with each other to form a color image when the material is subjected to exposure and color development.

Generally, a color reproduction technique according to subtractive color processes is used in this case. That is, in order to reproduce blue, green, and red, color images of their complementary colors, i.e., yellow, magenta, and cyan are formed. In the formation of a yellow image, an acylacetamide coupler and a malondianilide coupler are used as yellow dye forming couplers (to be referred to as yellow couplers hereinafter). In the formation of a magenta image, a 5-pyrazolone coupler and a pyrazolotriazole coupler are used as magenta couplers. In the formation of a cyan image, a phenol coupler and a naphthol coupler are used as cyan couplers.

Each of yellow, magenta, and cyan dyes obtained from these couplers is generally formed in a silver halide emulsion layer having a color sensitivity to radiant rays absorbed by that dye, or in a layer adjacent to the emulsion layer.

As the yellow coupler, particularly as a yellow coupler for image formation, acylacetamide couplers represented by a benzoylacetanilide coupler and a pivaloylacetanilide coupler are generally used. The former coupler has a high coupling activity with the oxidized form of an aromatic primary amine developing agent during development and can produce a yellow dye having a large molecular absorptivity coefficient. Therefore, this coupler is mainly used in a photographic color light-sensitive material required to have a high sensitivity, particularly in a color negative film. The latter coupler is excellent in spectral absorption characteristics and stability of a yellow dye and is therefore mainly used in color paper or a color reversal film.

The benzoylacetanilide type coupler has a high coupling activity with the oxidized form of an aromatic primary amine developing agent during color development and can produce a yellow azomethine dye having a large molecular absorptivity coefficient. However, this coupler has a problem of poor spectral absorption characteristics of a yellow image. The pivaloylacetanilide type coupler is excellent in spectral absorption characteristics of a yellow image but has a low coupling reactivity with the oxidized form of an aromatic primary amine developing agent during color development and a small molecular absorptivity coefficient of a produced yellow azomethine dye.

A high coupling reactivity of a coupler and a large molecular absorptivity coefficient of a produced dye enable a high sensitivity, a high gamma value, and a high color forming density, thereby yielding so-called high dye forming properties. Good spectral absorption characteristics of a yellow image means absorption characteristics in which the sharpness on the long-wavelength side of spectral absorption is good and an amount of unnecessary absorption in a green region is small.

A demand, therefore, has arisen for development of a yellow coupler having both the advantages of the two types of couplers, i.e., high dye forming properties (a high coupling reactivity of a coupler and a large molecular absorptivity coefficient of a dye) and good spectral absorption characteristics of a color image.

As examples of an acyl group of the acylacetanilide type coupler, U.S. Pat. No. 3,265,506 discloses a pivaloyl group, a 7,7-dimethylnorbornane-1-carbonyl group, and a 1-methylcyclohexane-1-carbonyl group, and JP-A-47-26133 ("JP-A" means Published Unexamined Japanese Patent Application) discloses a cyclopropane-1-carbonyl group and a cyclohexane-1-carbonyl group. However, each of these couplers is poor in any of the characteristics described above, i.e., low in a coupling reactivity, small in a molecular absorptivity coefficient of a dye, or poor in spectral absorption characteristics of a color image.

On the other hand, a method of using a water-insoluble polymer together with a coupler in a high boiling point organic solvent is disclosed in, e.g., U.S. Pat. Nos. 3,619,195, 4,201,589, or 4,120,725. WO/00723 and U.S. Pat. No. 5,006,453 describe an example in which a cyan coupler or a magenta coupler is codispersed with a water-insoluble polymer in order to improve the dye stability of that coupler. In addition to the above U.S. Patents, JP-A-64-50049 describes that the dye stability of a yellow coupler is improved by the use of a combination of a water-insoluble polymer and an epoxy compound.

In a silver halide color light-sensitive material, not only the spectral absorption characteristics of a yellow dye have an effect on yellow color reproduction. Generally, regardless of the structure of a dye to be produced, some formed dye images more or less have undesired absorption in a red light region or a green light region in yellow dye formed region and give turbid color image (hereinafter, referred "color tribidity") depending on the structure of a split-off group of the coupler or a combination of the arrangement of a light-sensitive material and the compositions of the development processing solutions.

Although the absorption of the color dye itself is excellent, grayish dark yellow is reproduced due to this color turbidity when the dye is used in a light-sensitive material.

Possible causes are, for example, a residual silver image caused by poor desilvering in a desilvering step, color mixing derived from interlayer movement of the oxidized form of a developing agent during development, and a coloring component produced by a side reaction of the oxidized form of a developing agent. However, the details or the extent of contribution of these causes are not well known. In addition, a dye image produced by an acylacetamide-based yellow coupler represented by formula (I) of the present invention is unsatisfactory in stability against light or heat and therefore must be improved.

SUMMARY OF THE INVENTION

The present invention has been made in consideration of the above situation and has as its first object to provide a silver halide color light-sensitive material having good spectral absorption characteristics and a good color reproducibility and, more particularly a silver halide color light-sensitive material in which a color turbidity in a red light region in yellow dye formed region is reduced.

It is a second object of the present invention to provide a silver halide color light-sensitive material having an improved dye image storage stability.

The above objects of the present invention are achieved by the following (1) A multilayered silver halide color light-sensitive material having a yellow dye forming silver halide emulsion layer, a magenta dye forming silver halide emulsion layer, and a cyan dye forming silver halide emulsion layer on a support, wherein at least one type of an acylacetamide-based yellow coupler in which the acyl group in the acylacetamide is represented by formula (I) below and at least one type of a water-insoluble polymer are contained in the yellow dye forming layer:

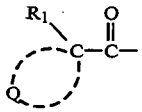

Formula (I)

wherein $R_1$ represents a monovalent group, and Q represents a nonmetallic atomic group required to form, together with C, a 3- to 5-membered hydrocarbon ring or a 3- to 5-membered heterocyclic ring having at least one hetero atom selected from N, S, O, and P in the ring, $R_1$ is not a hydrogen atom and is not combining with Q to form a ring to (2) A multilayered silver halide color light-sensitive material having a yellow dye forming silver halide emulsion layer, a magenta dye forming silver halide emulsion layer, and a cyan dye forming silver halide emulsion layer on a support, wherein at least one type of the acylacetamide-based yellow in which the acyl group in the acylacetamide is represented by formula (I) is contained in the yellow dye forming silver halide emulsion layer, and at least one type of a water-insoluble polymer is contained in the cyan dye forming silver halide emulsion layer.

(3) The silver halide color light-sensitive a material described in item (1) above, wherein at least one type of a water-insoluble polymer is contained in the cyan dye forming silver halide emulsion layer.

(4) The silver halide color light-sensitive material described in item (1) above, wherein the water-insoluble polymer is contained in the yellow dye forming layer at a percentage by weight of 20% or more with respect to the acylacetamide-based yellow coupler in which the acyl group in the acylacetamide is represented by formula (I).

DETAILED DESCRIPTION OF THE INVENTION

The acylacetamide-based yellow coupler for use in the present invention, in which the acyl group is represented by formula (I), will be described in more detail below.

The acylacetamide-based yellow coupler of the present invention is preferably represented by formula (Y) below:

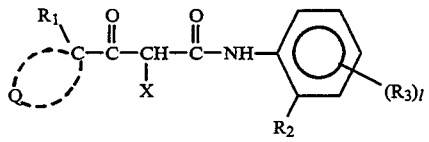

Formula (Y)

wherein $R_1$ represents a monovalent substituent except for hydrogen, Q represents a nonmetallic atomic group required to form, together with C, a 3- to 5-membered hydrocarbon ring or a 3- to 5-membered heterocyclic ring containing at least one hetero atom selected from N, S, O, and P in the ring, $R_2$ represents a hydrogen atom, a halogen atom (F, Cl, Br, or I; this will be the same in explanation of formula (Y) hereinafter), alkoxy, aryloxy, alkyl, or amino, $R_3$ represents a group substitutable on a benzene ring, X represents a group (to be referred to as a split-off group hereinafter) which can split off upon a coupling reaction with a hydrogen atom or an oxidized form of an aromatic primary amine developing agent, and l represents an integer from 0 to 4. If l represents a plural number, a plurality of $R_3$'s may be the same or different. $R_1$ is preferably an organic moiety not containing a metal atom, and more preferably a hydrocarbon group which may have a substituent.

Examples of $R_3$ are a halogen atom, alkyl, aryl, alkoxy, aryloxy, alkoxycarbonyl, aryloxycarbonyl, carbonamido, sulfonamido, carbamoyl, sulfamoyl, alkylsulfonyl, ureido, sulfamoylamino, alkoxycarbonylamino, alkoxysulfonyl, acyloxy, nitro, a heterocyclic group, cyano, acyl, acyloxy, alkylsulfonyloxy, and arylsulfonyloxy. Examples of the split-off group are a heterocyclic group, which is bonded to a coupling active position by a nitrogen atom, aryloxy, arylthio, acyloxy, alkylsulfonyloxy, arylsulfonyloxy, heterocyclic oxy, and a halogen atom.

If $R_1$, $R_2$, $R_3$ or the substituent on the 3- to 5-membered hydrocarbon or heterocyclic ring formed with Q and C of formula (Y) is an alkyl group or contains an alkyl group, this alkyl group means, unless defined otherwise, a straight-chain, branched, or cyclic alkyl group which may be substituted and may contain an unsaturated bond, (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, and phenoxyethyl).

If $R_1$, $R_2$, $R_3$ or the substituent on the 3- to 5-membered hydrocarbon or heterocyclic ring formed with Q and C of formula (Y) is an aryl group or contains an aryl group, this aryl group means a monocyclic or condensed-ring aryl group (e.g., phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, and 3,4-dichlorophenyl), unless defined otherwise.

If $R_1$, $R_2$, $R_3$ or the substituent on the 3- to 5-membered hydrocarbon or heterocyclic ring formed with Q and C of formula (Y) is a heterocyclic group or contains a heterocyclic group, this heterocyclic group means a 3- to 8-membered monocyclic or condensed-ring heterocyclic group which contains at least one hetero atom selected from O, N, S, P, Se, and Te in its ring and may be substituted (e.g., 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedione-3-yl), unless defined otherwise.

Substituents which can be preferably used in formula (Y) will be described below.

In formula (Y), $R_1$ is preferably a halogen atom, a cyano group, or a monovalent group (e.g., alkyl or alkoxy) having a total number of carbon atoms (to be referred to as a C number hereinafter) of 1 to 30 or a monovalent group (e.g., aryl or aryloxy) having a C number of 6 to 30, each monovalent group of which may be substituted. Examples of substituents of these monovalent groups are a halogen atom, alkyl, alkoxy, nitro, amino, carbonamido, sulfonamido,and acyl.

In formula (Y), Q preferably represents a nonmetallic atom group required to form, together with C, a 3- to 5-membered hydrocarbon ring which has a C number of 3 to 30 and may be substituted or a 3- to 5-membered heterocyclic group which contains at least one hetero atom selected from N, S, O, and P in the ring, has a C number of 2 to 30, and may be substituted. The ring that Q forms together with C may contain an unsaturated bond in it. Examples of the ring formed by Q with C are a cyclopropane ring, cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of the substituent are a halogen atom, hydroxyl, alkyl, aryl, acyl, alkoxy, aryloxy, cyano, alkoxycarbonyl, alkylthio, and arylthio.

In formula (Y), $R_2$ preferably represents a halogen atom, or alkoxy having a C number of 1 to 30, aryloxy having a C number of 6 to 30, alkyl having a C number of 1 to 30, or amino having a C number of 0 to 30, each of which may be substituted. Examples of the substituent are a halogen atom, an alkyl group, an alkoxy group, and an aryloxy group.

In formula (Y), $R_3$ preferably represents a halogen atom, or alkyl having a C number of 1 to 30, aryl having a C number of 6 to 30, alkoxy having a C number of 1 to 30, alkoxycarbonyl having a C number of 2 to 30, aryloxycarbonyl having a C number of 7 to 30, carbonamido having a C number of 1 to 30, sulfonamido having a C number of 1 to 30, carbamoyl having a C number of 1 to 30, sulfamoyl having a C number of 0 to 30, alkylsulfonyl having a C number of 1 to 30, arylsulfonyl having a C number of 6 to 30, ureido having a C number of 1 to 30, sulfamoylamino having a C number of 0 to 30, alkoxycarbonylamino having a C number of 2 to 30, a heterocyclic group having a C number of 1 to 30, acyl having a C number of 1 to 30, alkylsulfonyloxy having a C number of 1 to 30, or arylsulfonyloxy having a C number of 6 to 30, each of which may be substituted. Examples of the substituent are a halogen atom, alkyl, aryl, a heterocyclic group, alkoxy, aryloxy, heterocyclicoxy, alkylthio, arylthio, heterocyclic thio, alkylsulfonyl, arylsulfonyl, acyl, carbonamido, sulfonamido, carbamoyl, sulfamoyl, alkoxycarbonylamino, sulfamoylamino, ureido, cyano, nitro, acyloxy, alkoxycarbonyl, aryloxycarbonyl, alkylsulfonyloxy, and arylsulfonyloxy.

In formula (Y), l preferably represents an integer of 1 or 2, and the substitution position of $R_3$ is preferably a meta or para position with respect to a group represented by formula (Y-a):

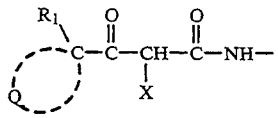

Formula (Y-a)

In formula (Y), X preferably represents a heterocyclic group which is bonded to a coupling active position by a nitrogen atom or an aryloxy group.

When X represents a heterocyclic group, X is preferably a 5- to 7-membered monocyclic or condensed-ring heterocyclic group which may be substituted. Examples of this heterocyclic group are succinimide, maleinimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4thiazolidine, and 2-imino-1,3,4-thiazolidine-4-one. These heterocyclic rings may be substituted. Examples of the substituent are a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, an ureido group, an alkoxycarbonylamino group, and a sulfamoylamino group. When X represents an aryloxy group, X is preferably an aryloxy group having a C number of 6 to 30 and may be substituted with a group selected from the substituents enumerated above as substituents for X representing a heterocyclic ring. Preferable examples of the substituent for the aryloxy group are a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, and a cyano group.

Substituents which can be particularly preferably used in formula (Y) will be described below.

$R_1$ is particularly preferably a halogen atom or a substituted or nonsubstituted alkyl group, more preferably an alkyl group having no branch on an $\alpha$ or $\beta$ position, much more preferably a straight-chain alkyl group having a C number of 1 to 4, and most preferably an ethyl group. Q is particularly preferably a nonmetallic atom group for forming a 3- to 5-membered hydrocarbon ring together with C, for example, $-(CR_2)_2-$, $-(CR_2)_3-$, or $-(CR_2)_4-$ wherein R represents a hydrogen atom, a halogen atom, or an alkyl group. Note that a plurality of R's and $CR_2$'s may be the same or different.

Q is most preferably $-(CR_2)_2-$ which forms a 3-membered ring together with C.

$R_2$ is particularly preferably a chlorine atom, a fluorine atom, alkyl (e.g., methyl, trifluoromethyl, ethyl, isopropyl, and t-butyl) having a C number of 1 to 6, alkoxy (e.g., methoxy, ethoxy, methoxyethoxy, and butoxy) having a C number of 1 to 8, or aryloxy (e.g., a phenoxy group, p-tolyloxy, and p-methoxyphenoxy) having a C number of 6 to 24, and most preferably a chlorine atom, a methoxy group, or a trifluoromethyl group.

$R_3$ is particularly preferably a halogen atom, an alkoxy group, an alkoxycarbonyl group, an aryloxycarbonyl group, a carbonamido group, a sulfonamido group, a carbamoyl group, or a sulfamoyl group, and most preferably an alkoxy group, an alkoxycarbonyl group, a carbonamido group, or a sulfonamido group.

X is particularly preferably a group represented by formula (Y-1), (Y-2), or (Y-3) below:

Formula (Y-1)

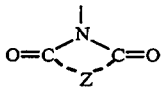

in formula (Y-1) Z represents —O—$CR_4(R_5)$—, —S—$CR_4(R_5)$—, —$NR_6$—$CR_4(R_5)$—, $NR_6$—$NR_7$—, —$NR_6$—C(O)—, —$CR_4(R_5)$—$CR_8(R_9)$—, or —$CR_{10}$=$CR_{11}$—.

Each of $R_4$, $R_5$, $R_8$, and $R_9$ represents a hydrogen atom, alkyl, aryl, alkoxy, aryloxy, alkylthio, arylthio, alkylsulfonyl, arylsulfonyl, or amino. Each of $R_6$ and $R_7$ represents a hydrogen atom, alkyl, aryl, alkylsulfonyl, arylsulfonyl, or alkoxycarbonyl. Each of $R_{10}$ and $R_{11}$ represents a hydrogen atom, alkyl, or aryl. $R_{10}$ and $R_{11}$ may combine together to form a benzene ring. $R_4$ and $R_5$, $R_5$ and $R_6$, $R_6$ and $R_7$, or $R_4$ and $R_8$ may combine together to form a ring (e.g., cyclobutane, cyclohexane, cycloheptane, cyclohexene, pyrrolidine, or pyperidine).

A most preferable example of the heterocyclic group represented by formula (Y-1) is a heterocyclic group in which Z is —O —$CR_4(R_5)$—, —$NR_6$—$CR_4(R_5)$—, or —$NR_6$—$NR_7$— in formula (Y-1). The C number of a heterocyclic group represented by formula (Y-1) is 2 to 30, preferably 4 to 20, and more preferably 5 to 16.

Formula (Y-2)

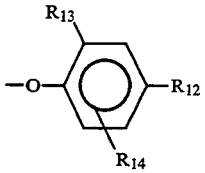

in formula (Y-2), at least one of $R_{12}$ and $R_{13}$ may be a group selected from a halogen atom, cyano, nitro, trifluoromethyl, carboxyl, alkoxycarbonyl, carbonamido, sulfonamido, carbamoyl, sulfamoyl, alkylsulfonyl, arylsulfonyl, and acyl, and the other may be a hydrogen atom, alkyl, or alkoxy. $R_{14}$ represents a group having the same meaning as $R_{12}$ or $R_{13}$, and m represents an integer of 0 to 2. The C number of an aryloxy group represented by formula (Y-2) is 6 to 30, preferably 6 to 24, and more preferably 6 to 15.

Formula (Y-3)

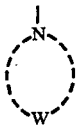

in formula (Y-3), W represents a nonmetallic atom group required to form, together with N, a pyrrole ring, a pyrazole ring, an imidazole ring, or a triazole ring. A ring represented by formula (Y-3) may have a substituent. Preferable examples of the substituent are a halogen atom, nitro, cyano, alkoxycarbonyl, alkyl, aryl, amino, alkoxy, aryloxy, or carbamoyl. The C number of a heterocyclic group represented by (Y-3) is 2 to 30, preferably 2 to 24, and more preferably 2 to 16.

X is most preferably a group represented by formula (Y-1).

A coupler represented by formula (Y) may form dimers or higher polymers, which combine together via a divalent group or a higher group, in the substituent $R_1$, Q, x, or a group represented by formula (Y-b) below. In this case, the number of carbon atoms described above in each substituent may fall outside the defined range:

Formula (Y-b)

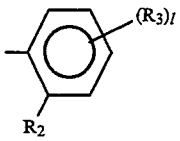

Specific examples of each substituent in formula (Y) will be described below.

Specific examples

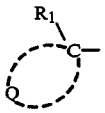

in formula (Y):

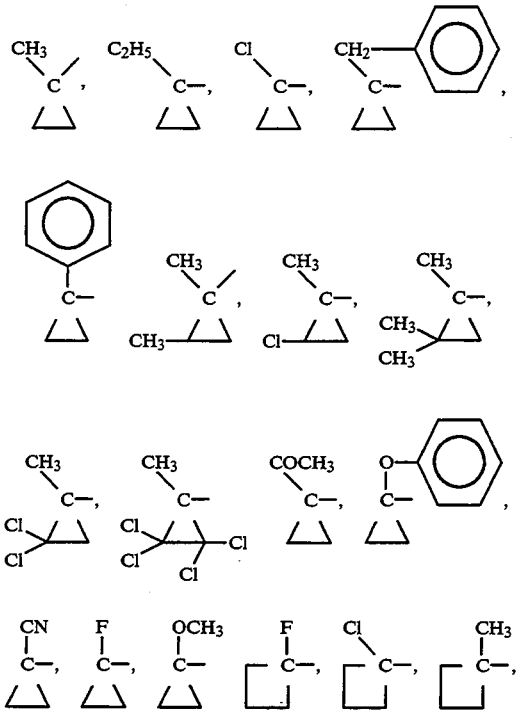

-continued

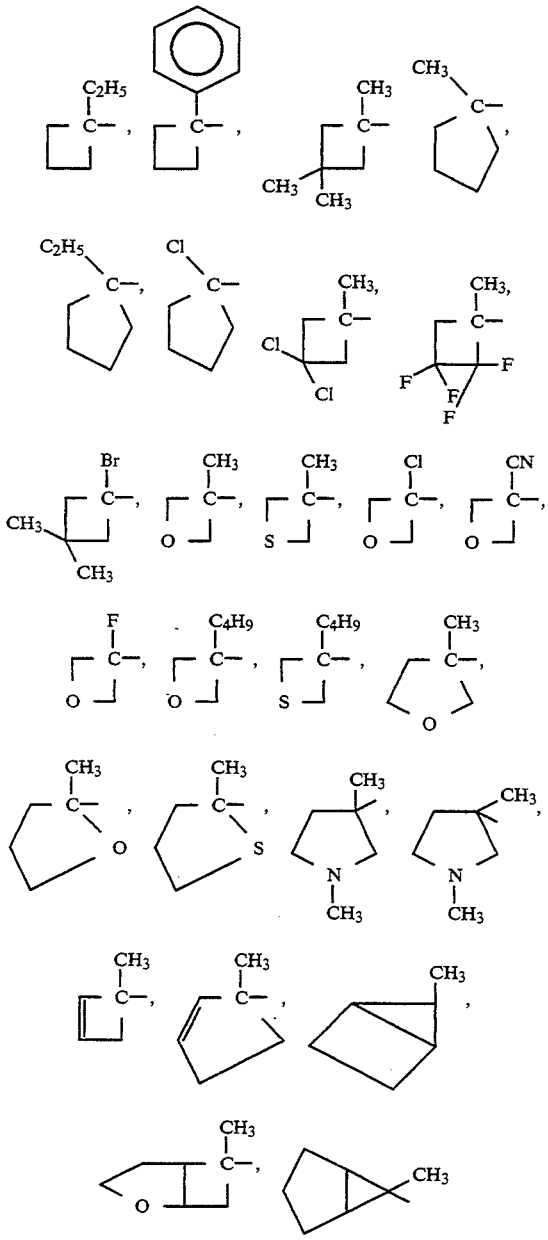

Specific examples of $R_2$ in formula (Y):

F, Cl, Br, I, $CH_3O$—, 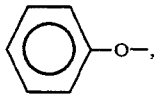

$CH_3O$— 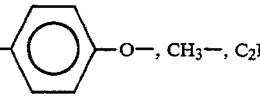 , $CH_3$—, $C_2H_5$—, i-$C_3H_7$—, t-$C_4H_9$—, $CH_3OCH_2CH_2O$—, $CF_3$—, $(CH_3)_2N$—, 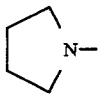

n-$C_4H_9O$—, n-$C_{14}H_{29}O$—, n-$C_{16}H_{33}O$—,

-continued

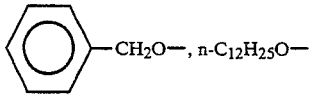

Specific examples of $R_3$ in formula (Y):

F, Cl, Br, I, $CH_3O$—, $C_2H_5O$—, n-$C_{12}H_{25}O$—, $CH_3$, t-$C_4H_9$—, —$COOCH_3$, $COOC_2H_5$, —$COOC_4H_9$-n,

—$COOC_{12}H_{25}$-n, —$OCH_2CH(C_6H_{13}\text{-n})C_8H_{17}$-n, —$COOCH(CH_3)COOC_{12}H_{25}$-n, —$COOCH(C_4H_9\text{-n})COOC_{12}H_{25}$-n, —COO— 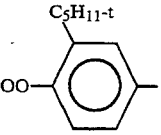

—$CON(CH_2)_3O$— 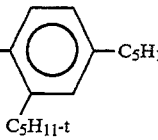

—$SO_2NH(CH_2)_4O$— 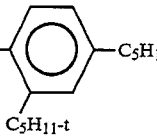 , —$SO_2N(CH_3)_2$,

—$SO_2NHCOC_2H_5$, —$SO_2NHC_{16}H_{33}$-n, —$NHCOC_{13}H_{27}$-n,

—$NHCOC_{15}H_{31}$-n, —$NHCOC_{17}H_{35}$-n —$NHCOCH(C_6H_{13}\text{-n})$—$C_8H_{17}$-n, —$NHCOCH(CHCH_2C_4H_9\text{-t})$—$CH_2CH_2CH(CH_3)CH_2C_4H_9$-t —$NHCOCH(CH_3)CH_2SO_2C_{16}H_{33}$-n, —$NHCO(CH_2)_3O$— 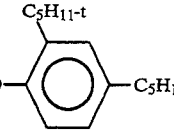

—$NHCOCH(C_2H_5)O$— 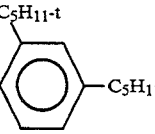

—$NHCOCH(C_3H_7\text{-i})SO_2C_{16}H_{33}$-n, —$NHSO_2C_{12}H_{25}$-n,

—$NHSO_2C_{16}H_{33}$-n, —$NHSO_2$— 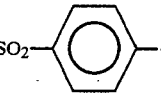

-continued
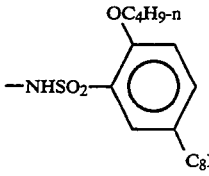
, —$SO_2NHCH_3$,
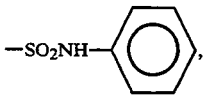
, —$OCOC_{11}H_{23}$-n, —$OSO_2C_{12}H_{25}$-n,
—$NHCOOC_{12}H_{25}$-n,
Specific examples of X in formula (Y):
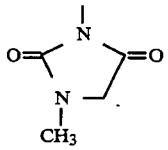
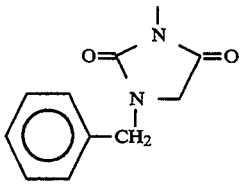
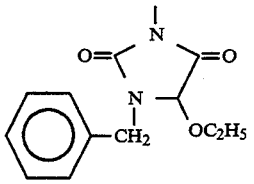
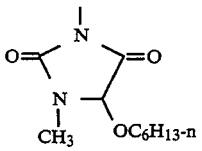
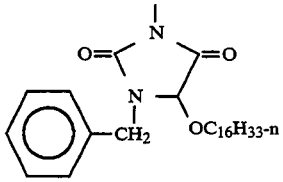
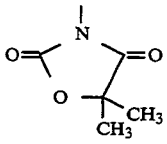
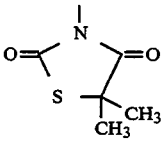
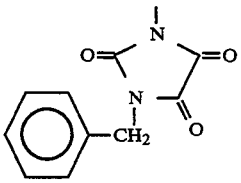
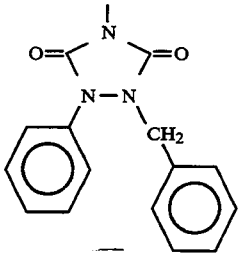
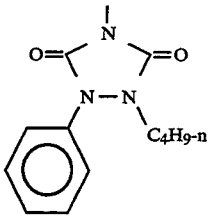
-continued
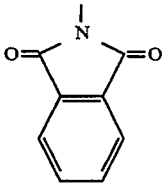
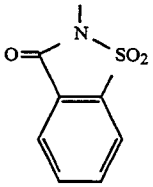
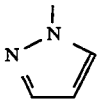
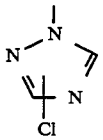
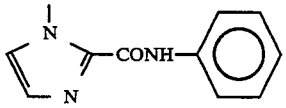
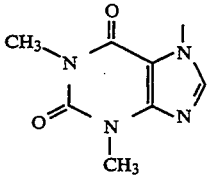
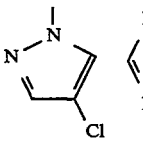
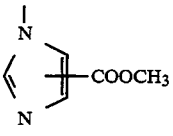
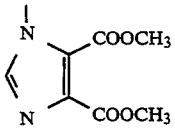
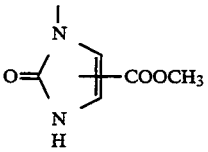
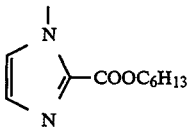
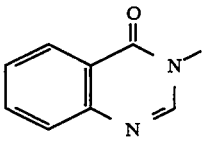
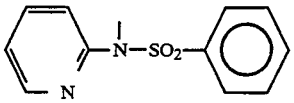
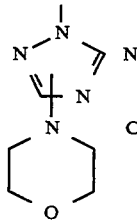
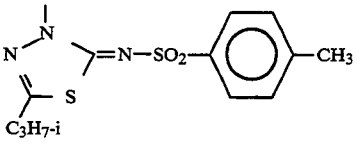
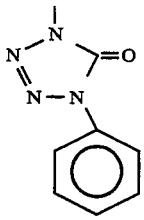
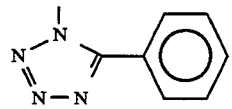
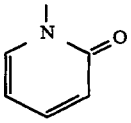
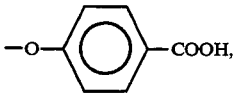
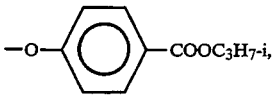
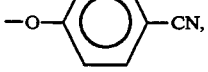
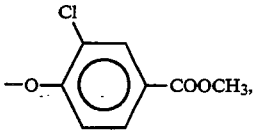

-continued
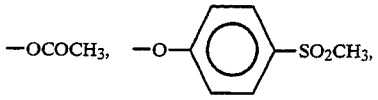
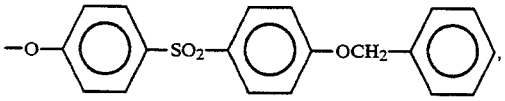
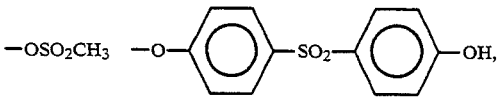
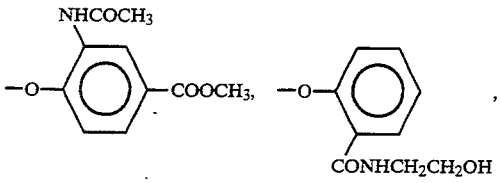
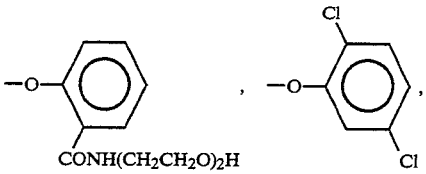
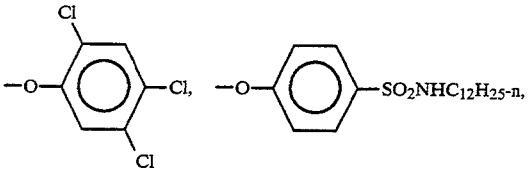
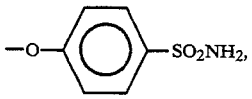
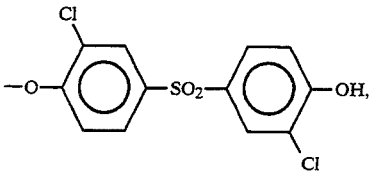
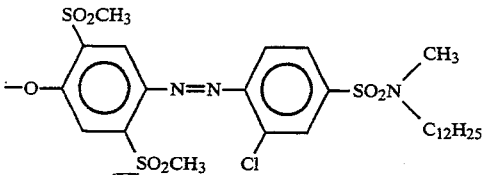
-continued
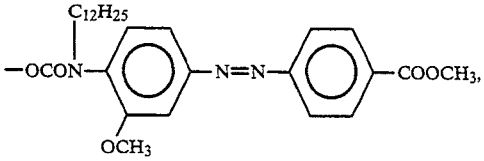
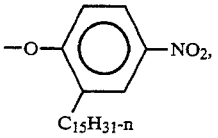
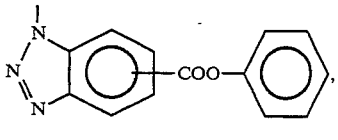
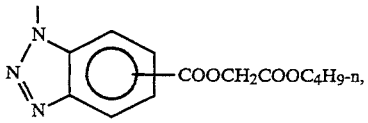
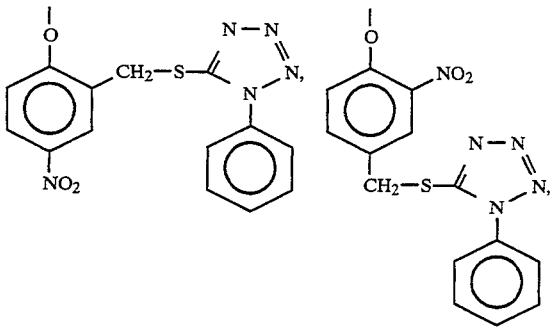
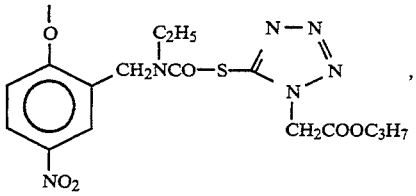
Specific examples of a yellow coupler represented by formula (Y) will be presented below.

Y-1
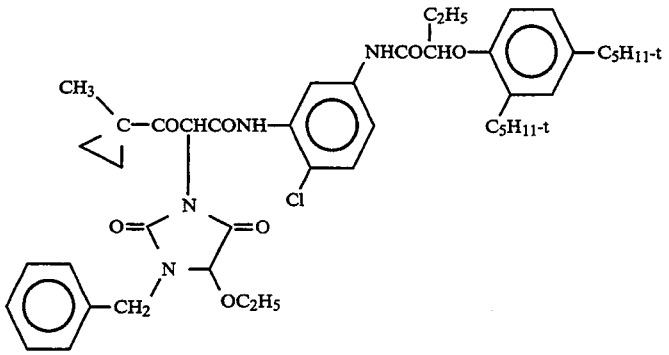
Y-2
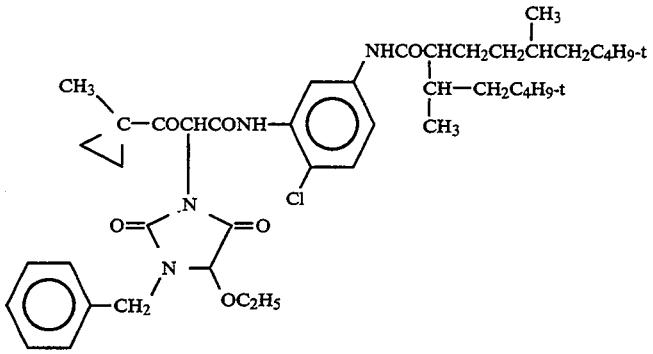
Y-3
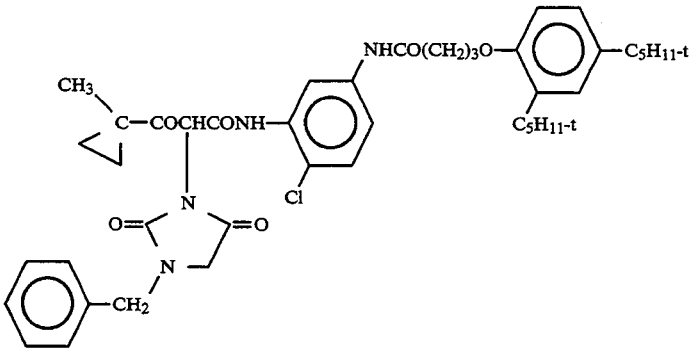
Y-4
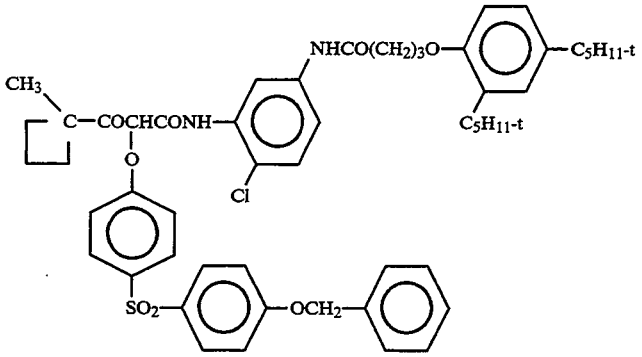

-continued
Y-5
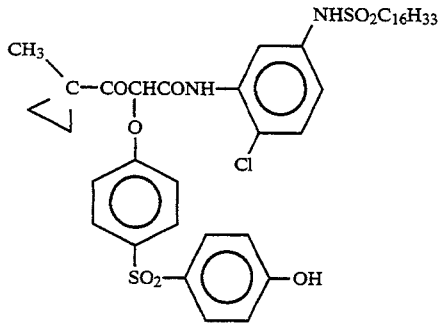
Y-6
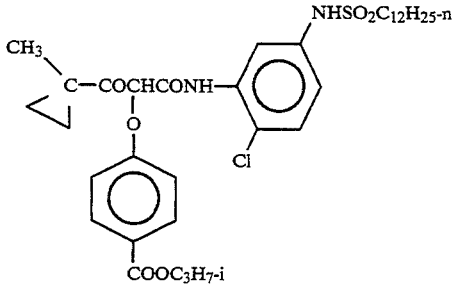
Y-7
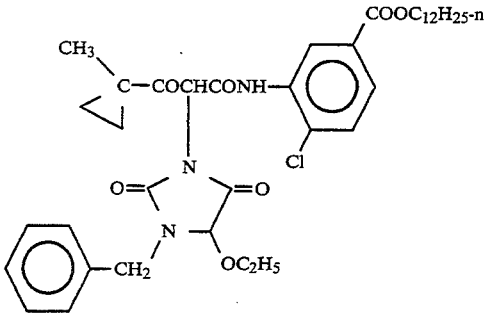
Y-8
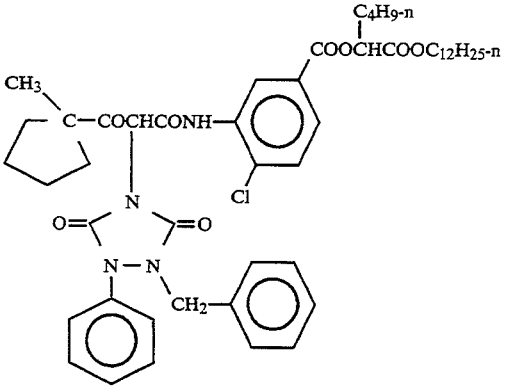
Y-9
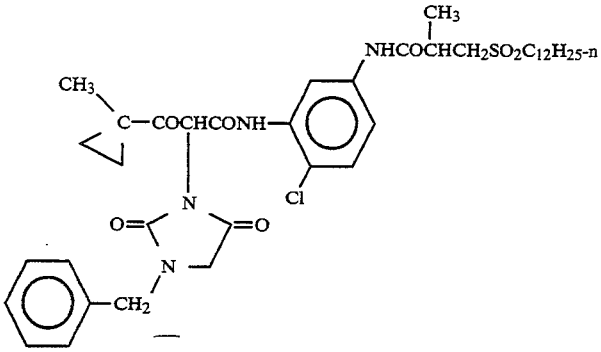

-continued
Y-10
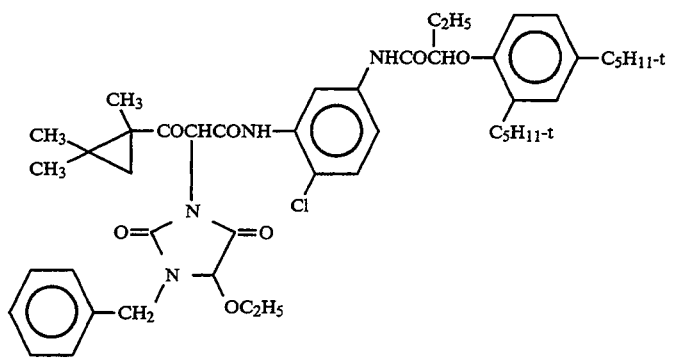
Y-11
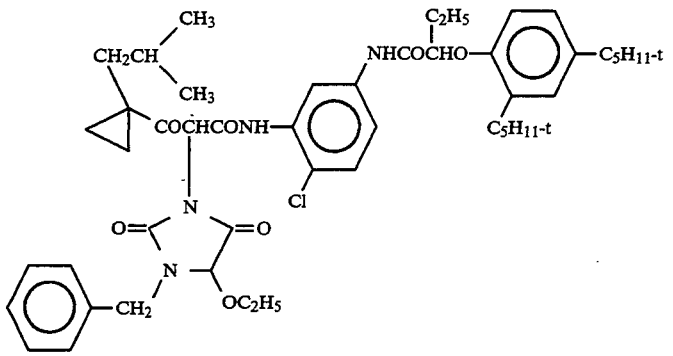
Y-12
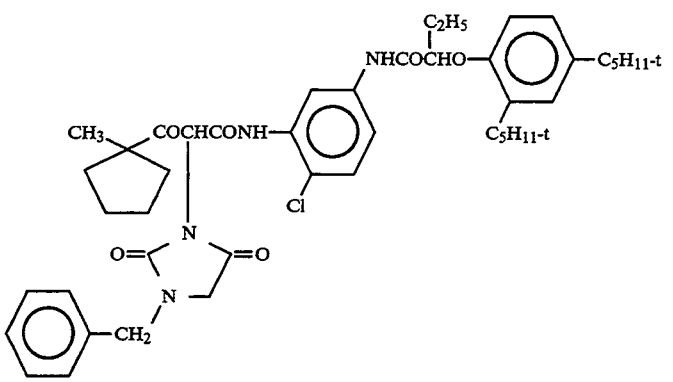
Y-13
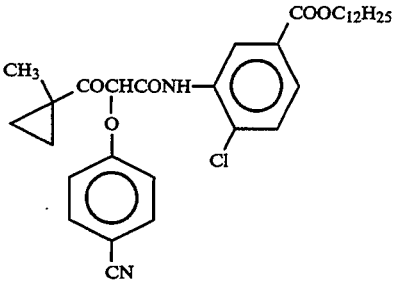

-continued
Y-14
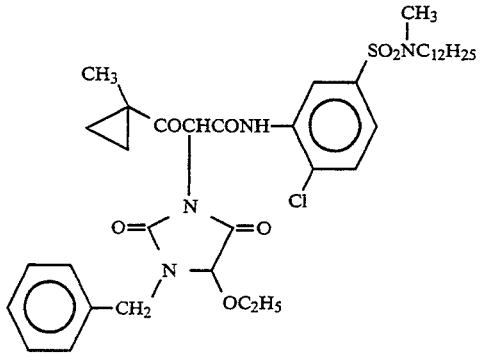
Y-15
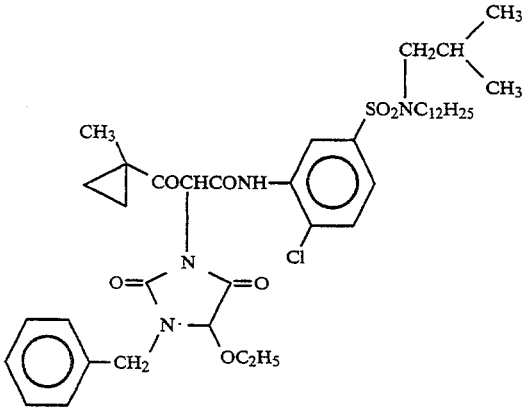
Y-16
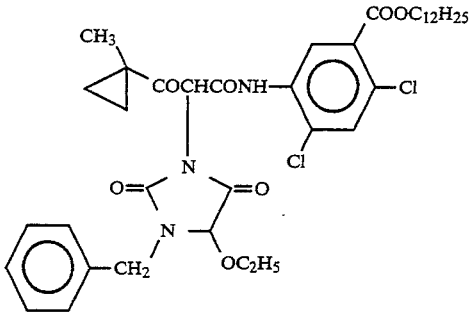
Y-17
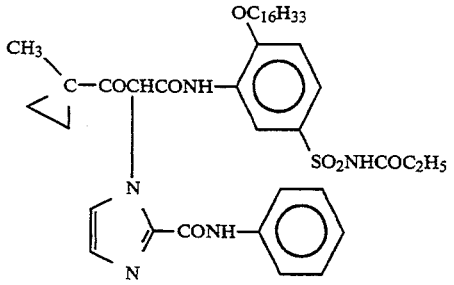
Y-18
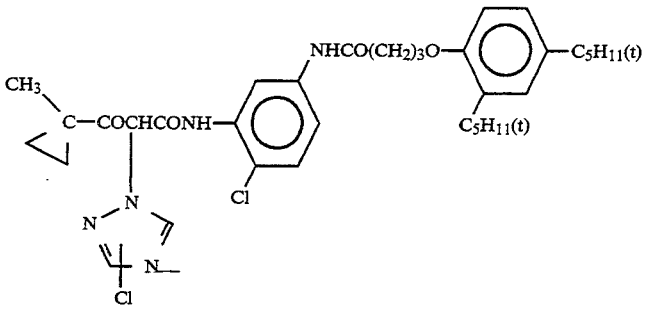

-continued
Y-19
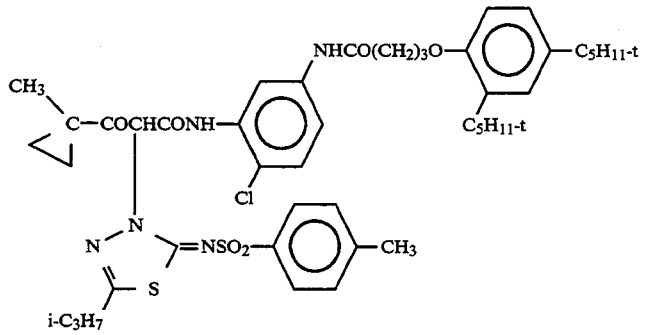
Y-20
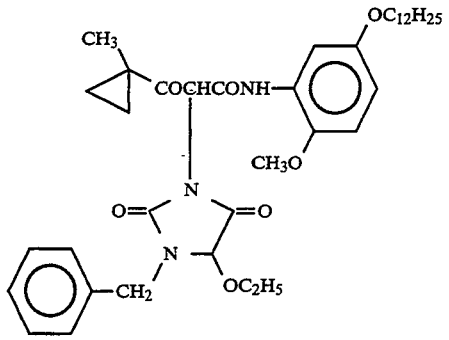
Y-21
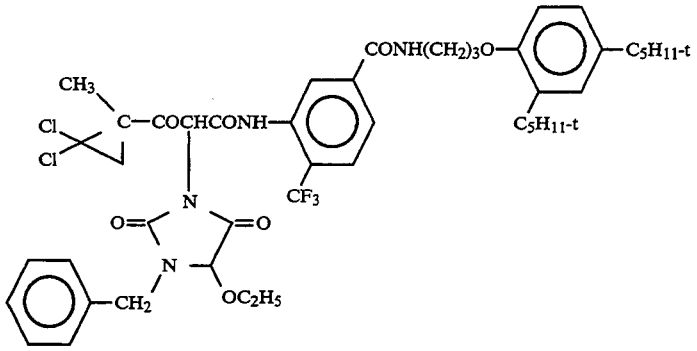
Y-22
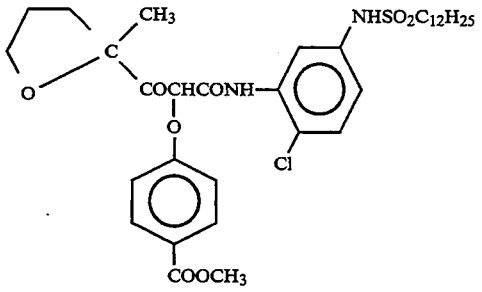

-continued
Y-23
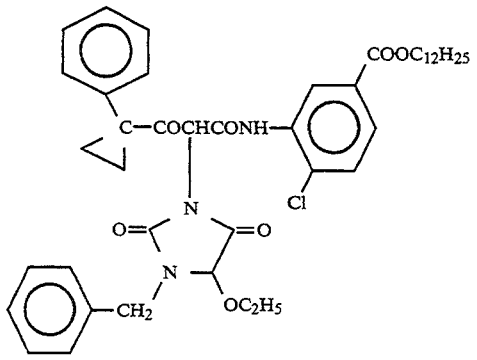
Y-24
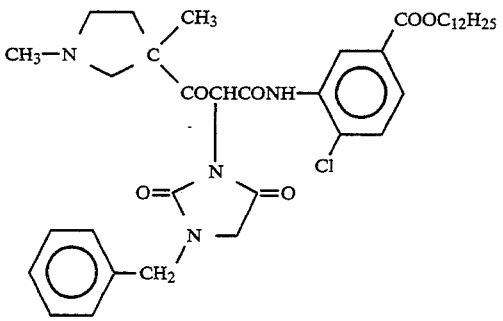
Y-25
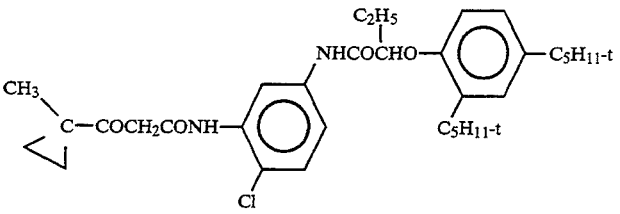
Y-26
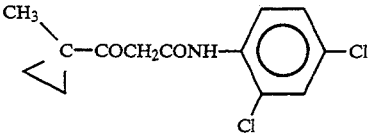
Y-27
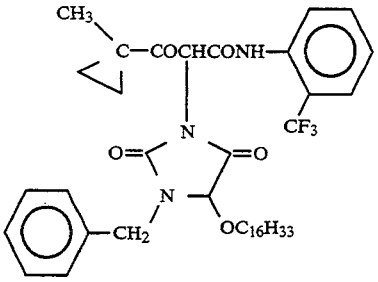

-continued
Y-28
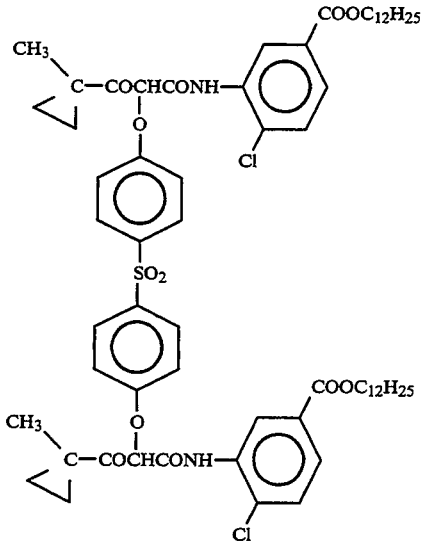
Y-29
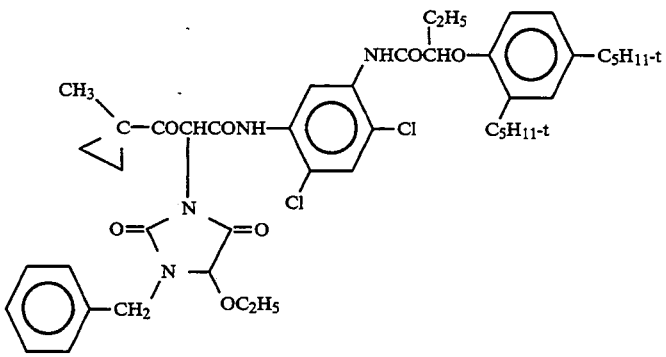
Y-30
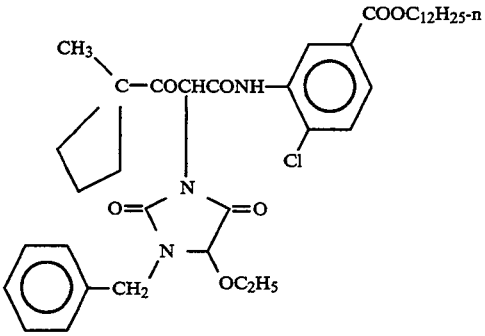
Y-31
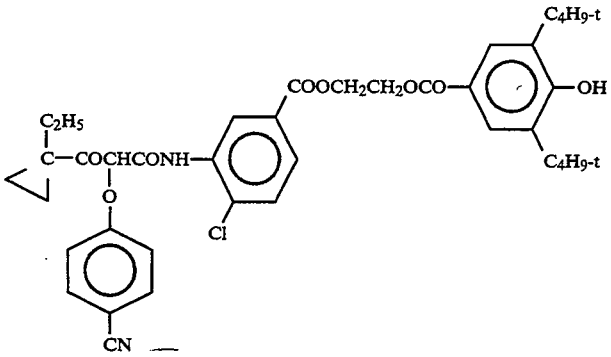

-continued
Y-32
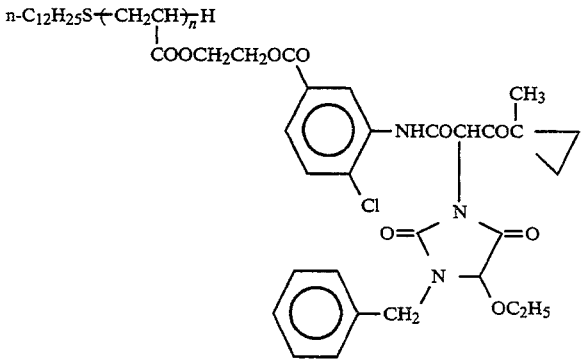
n = 3 (mean value)
Y-33
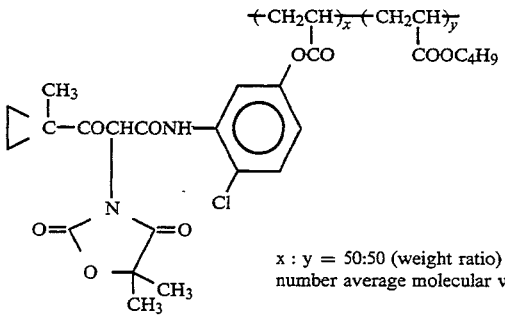
x : y = 50:50 (weight ratio)
number average molecular weight 50,000
Y-34
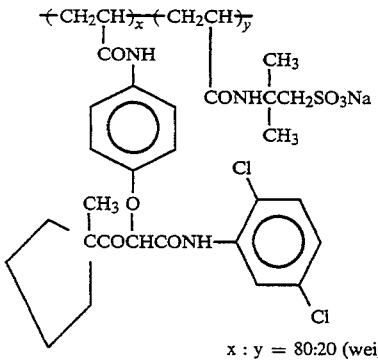
x : y = 80:20 (weight ratio)
number average molecular weight 70,000
Y-35
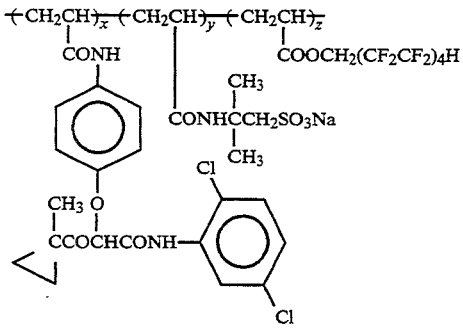
x : y : z = 50:30:30 (weight ratio)
number average molecular weight 70,000

-continued
Y-36
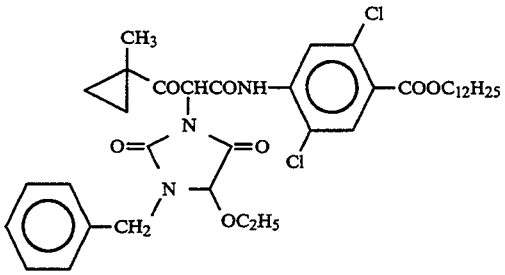
Y-37
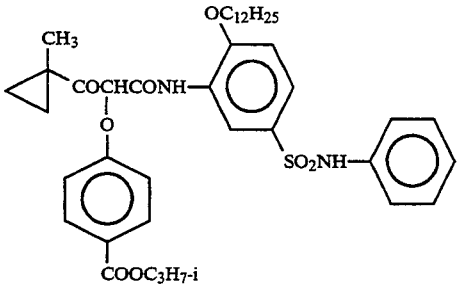
Y-38
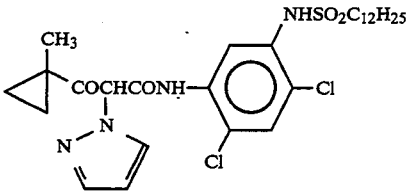
Y-39
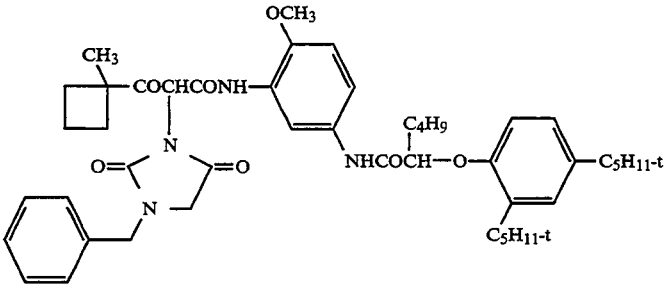
Y-40
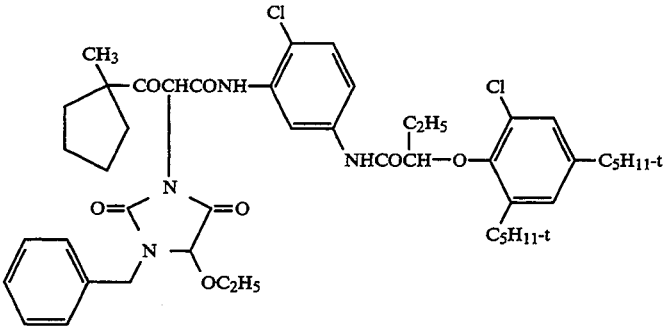
Y-41
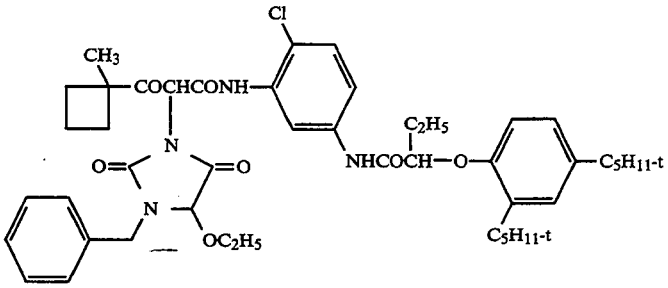

-continued
Y-42
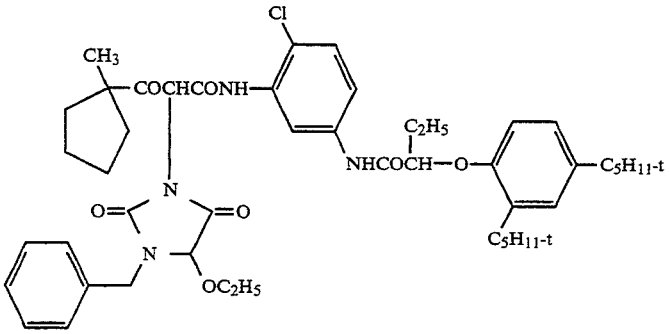
Y-43
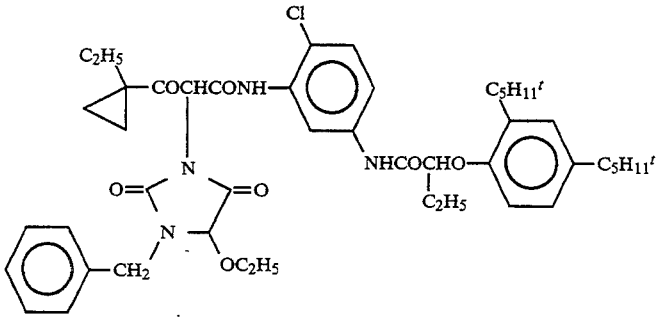
Y-44
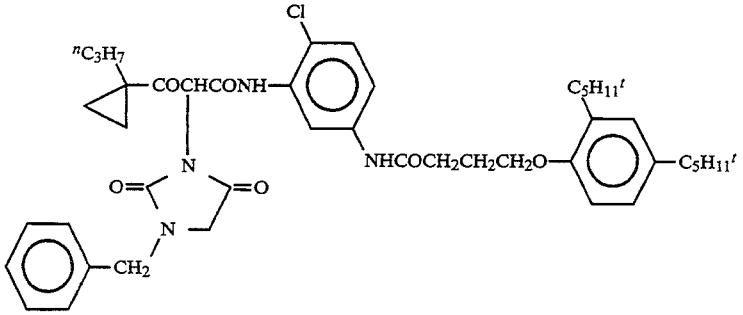
Y-45
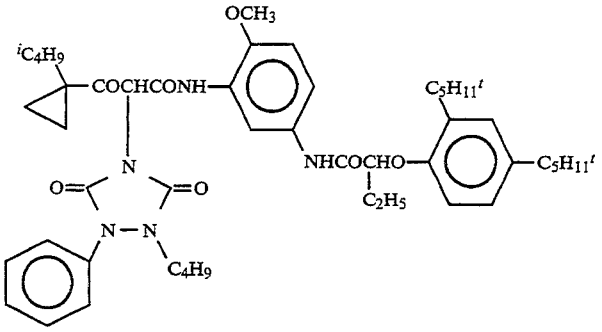
Y-46
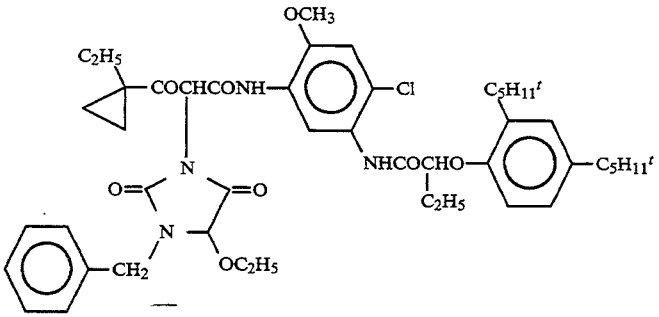

-continued
Y-47
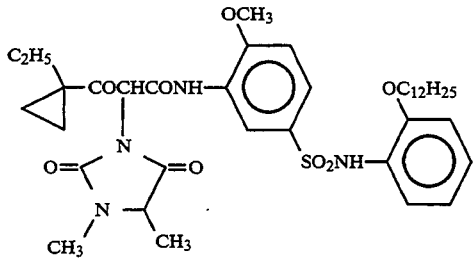
Y-48
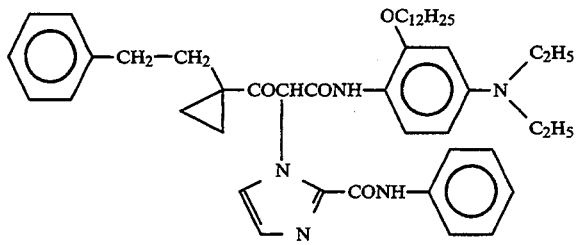
Y-49
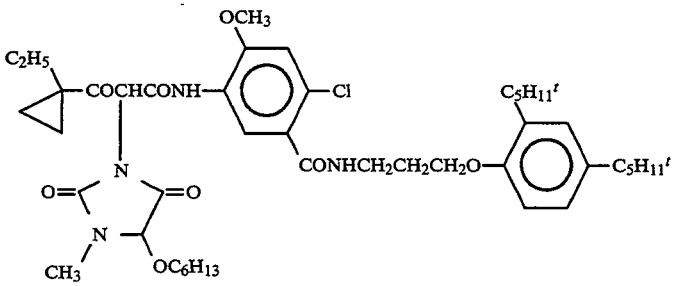
Y-50
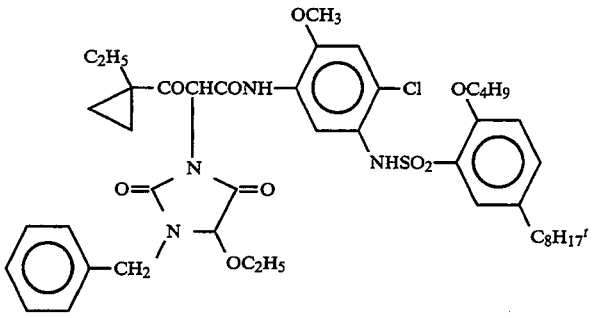
Y-51
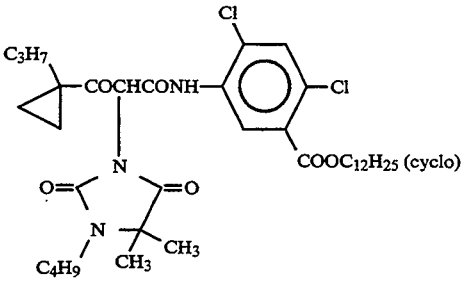

-continued
Y-52
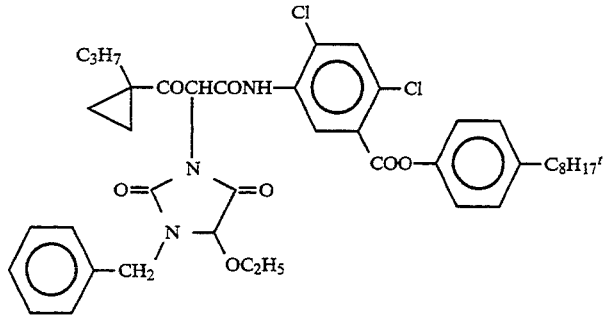
Y-53
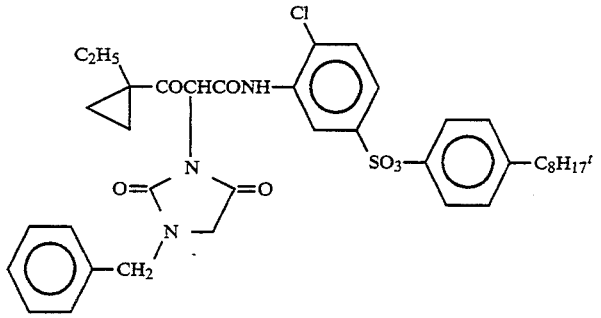
Y-54
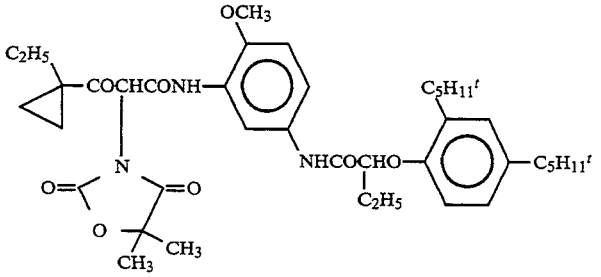
Y-55
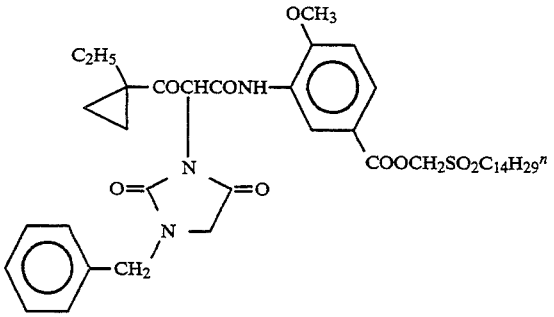
Y-56
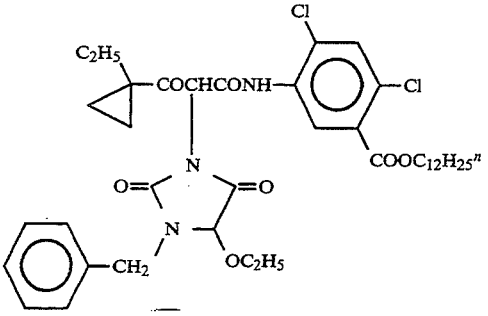

-continued
Y-57
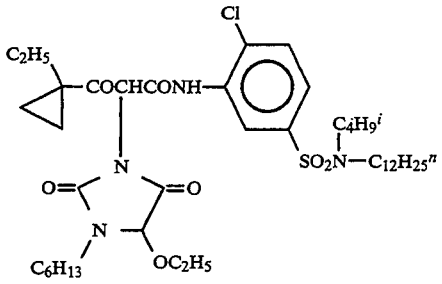
Y-58
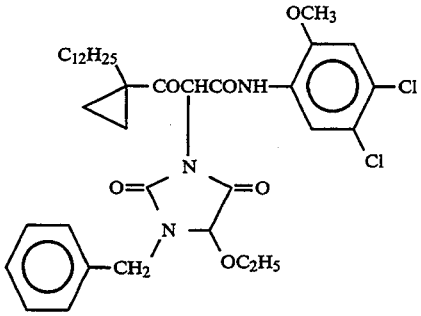
Y-59
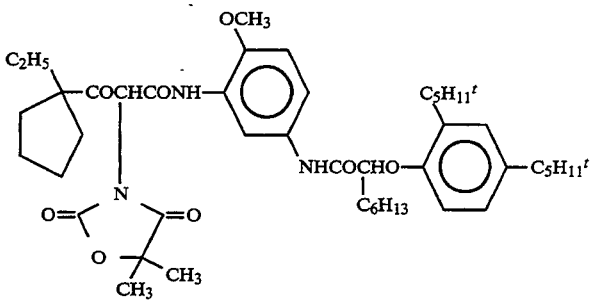
Y-60
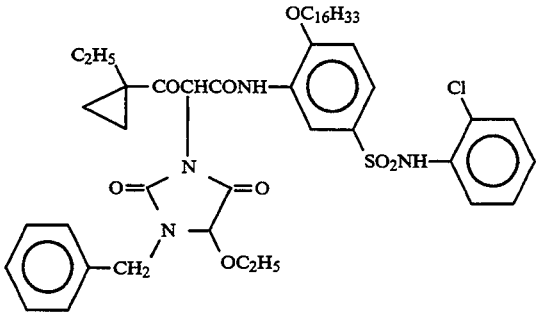
The yellow coupler of the present invention represented by formula (Y) can be synthesized by the following synthesis route.
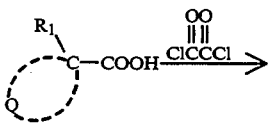
a
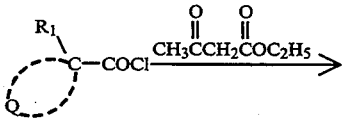
b
-continued
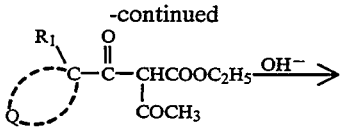
c
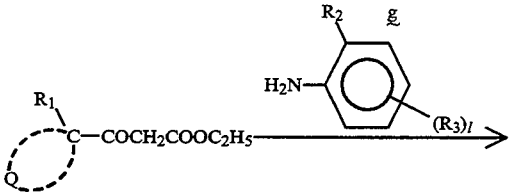
d -continued

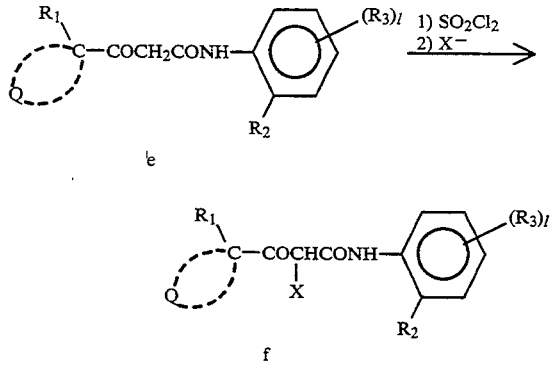

The compound a is synthesized by methods described in, e.g., J. Chem. Soc. (C), 1968, 2548, J. Am. Chem. Soc., 1934, 56, 2710, Synthesis, 1971, 258, J. Org. Chem., 1978, 43, 1729, CA, 1960, 66, 18533y.

The synthesis of the compound b is performed by using thionyl chloride or oxalyl chloride in the absence of a solvent or in a solvent such as methylene chloride, chloroform, carbon tetrachloride, dichloroethane, toluene, N,N-dimethylformamide, or N,N-dimethylacetamide. The reaction temperature is −20° C. to 150° C., and preferably −10° C. to 80° C.

The compound c is synthesized by converting ethyl acetoacetate into an anion by using, e.g., magnesium methoxide and adding the compound b to the anion. The reaction is performed in the absence of a solvent or by using tetrahydrofuran or ethylether, and the reaction temperature is normally −20° C. to 60° C., and preferably −10° C. to 30° C. The compound d is synthesized by reacting the compound c with a base, such as ammonia water, an aqueous $NaHCO_3$ solution, or an aqueous sodium hydroxide solution, in the absence of a solvent or in a solvent such as methanol, ethanol, or acetonitrile. The reaction temperature is normally −20° C. to 50° C., and preferably −10° C. to 30° C.

The compound e is synthesized by reacting the compounds d and g in the absence of a solvent. The reaction temperature is normally 100° C. to 150° C., and preferably 100° C. to 120° C. If X is not H, the split-off group X is introduced to synthesize the compound f after chlorination or bromination. The compound e is formed into a chloro substitution product by using, e.g., sulfuryl chloride or N-chlorosuccinimide or into a bromo substitution product by using, e.g., bromine or N-bromosuccinimide in a solvent such as dichloroethane, carbon tetrachloride, chloroform, methylene chloride, or tetrahydrofuran. At this time, the reaction temperature is −20° C. to 70° C., and preferably −10° C. to 50° C.

The coupler f of the present invention can be obtained by reacting the chloro substitution product or the bromo substitution product with a proton adduct H—X of a split-off group in a solvent such as methylene chloride, chloroform, tetrahydrofuran, acetone, acetonitrile, dioxane, N-methylpyrrolidone, N,N'-dimethylimidazolidine-2-one, N,N-dimethylformamide, or N,N-dimethylacetamide at a reaction temperature of −20° C. to 150° C., and preferably −10° C. to 100° C. At this time, it is possible to use a base such as triethylamine, N-ethylmorpholine, tetramethylguanidine, potassium carbonate, sodium hydroxide, or sodium bicarbonate.

Synthesis examples of the couplers of the present invention will be described below.

Synthesis Example 1

Synthesis of exemplified compound Y-25

38.1 g of oxalylchloride were dropped in a mixture of 25 g of 1-methylcyclopropanecarboxylic acid synthesized by the method described in Gotkis, D. et. al., J. Am. Chem. Soc., 1934, 56, 2710, 100 ml of methylene chloride, and 1 ml of N,N-dimethylformamide, at room temperature over 30 minutes. After the dropping, the resultant mixture was reacted at room temperature for two hours, and the methylene chloride and an excess of oxalylchloride were removed under reduced pressure obtained by an aspirator. The result was an oily product of 1-methylcyclopropanecarbonylchloride.

100 ml of methanol were dropped in a mixture of 6 g of magnesium and 2 ml of carbon tetrachloride at room temperature over 30 minutes. The resultant mixture was heated under reflux for two hours, and 32.6 g of ethyl 3-oxobutyrate were dropped under reflux with heat over 30 minutes. After the dropping, the methanol was perfectly distilled off under reduced pressure obtained by an aspirator. 100 ml of tetrahydrofuran were dispersed in the reaction product, and the 1-methylcyclopropanecarbonylchloride obtained above was dropped at room temperature. After the reaction was continued for 30 minutes, the reaction solution was extracted with 300 ml of ethyl acetate and diluted sulfuric acid. The organic layer was washed with water and dried by sodium sulfate anhydride. Thereafter, the solvent was distilled off to obtain 55.3 g of an oily product of ethyl 2-(1-methylcyclopropanecarbonyl)-3-oxobutyrate.

A solution of 55 g of the ethyl 2-(1-methylcyclopropanecarbonyl)-3-oxobutyrate and 160 ml of ethanol was stirred at room temperature, and 60 ml of 30% ammonia water were dropped in the solution over 10 minutes. The resultant solution was stirred for one hour and extracted with 300 ml of ethyl acetate and diluted hydrochloric acid. After neutralized and washed with water, the organic layer was dried by sodium sulfate anhydride, and the solvent was distilled off. The result was 43 g of an oily product of ethyl (1-methylcyclopropanecarbonyl)acetate.

34 g of the ethyl (1-methylcyclopropanecarbonyl-)acetate acid and 44.5 g of N-(3-amino-4-chlorophenyl)-2-(2,4-di-t-pentylphenoxy)butaneamide were heated under reflux at an internal temperature of 100° C. to 120° C. under reduced pressure obtained by an aspirator. After the reaction was continued for four hours, the reaction solution was purified through a column chromatography using a solvent mixture of n-hexane and ethyl acetate to obtain 49 g of a viscous oily product of exemplified compound Y-25. The structure of the compound was confirmed by an MS spectrum, an NMR spectrum, and elemental analysis.

Synthesis Example 2

Synthesis of exemplified compound Y-1

22.8 g of exemplified compound Y-25 were dissolved in 300 ml of methylene chloride, and 5.4 g of sulfuryl chloride were dropped under ice cooling over 10 minutes. After the reaction was continued for 30 minutes, the reaction solution was washed well with water. The resultant solution was dried by sodium sulfate anhydride and condensed to obtain a chloride of exemplified compound Y-25. This chloride of exemplified compound Y-25 was dissolved in 50 ml of N,N-dimethylformaldehyde, and the resultant solution was dropped in a solution of 18.7 g of 1-benzyl-5-ethoxyhydantoin, 11.2 ml of triethylamine, and 500 ml of N,N-dimethylformamide at room temperature over 30 minutes.

Thereafter, the reaction was continued at 40° C. for four hours, and the reaction solution was extracted with 300 ml of ethyl acetate. After washed with water, the resultant material was washed with 300 ml of a 2% aqueous triethylamine solution and neutralized by diluted hydrochloric acid. After the organic layer was dried by sodium sulfate anhydride, the solvent was distilled off to obtain an oily product. This oily product was crystallized from a solvent mixture of n-hexane and ethyl acetate. The precipitated crystals were filtered out, washed with a solvent mixture of n-hexane and ethyl acetate, and dried. As a result, 22.8 g of crystals of exemplified compound Y-1 were obtained.

The structure of the compound was confirmed by an MS spectrum, an NMR spectrum, and elemental analysis. The melting point was 132° C. to 133° C.

The amount of the acylacetamide-based yellow coupler of the present invention in the silver halide color light-sensitive material is preferably 0.01 to 5 mmol/$m^2$, and more preferably 0.1 to 2 mmol/$m^2$.

Polymers described in WO88/00723 and JP-A-63-44658 can be used as the polymer of the present invention.

Although the polymer for use in the present invention may be any polymer as long as it is insoluble in water, a vinyl polymer and a polyester-based polymer, in which a repeating unit has a —(C═O)— bond, are most preferable in terms of prevention of cyan color turbidity.

As a vinyl monomer to be preferably used in the polymer of the present invention, two or more types of monomers are used as comonomers in accordance with various purposes (e.g., purpose of improving a solubility). In order to control color forming properties or solubility, a monomer having an acid radical can also be used as a comonomer provided that the copolymer is not water-soluble. In addition, a monomer having two or more ethylene unsaturated components which is crosslinkable can be used. A preferable example of this monomer is described in JP-A-60-151636.

When a hydrophilic monomer (in this case, a monomer which becomes water-soluble when formed into a homopolymer) is used as a comonomer in the vinyl monomer of the present invention, the ratio of the hydrophilic monomer in the copolymer is not particularly limited as long as the copolymer is not water-soluble. However, the ratio is preferably 40 mol % or less, more preferably 20 mol % or less, and most preferably 10 mol % or less. If the hydrophilic comonomer to be copolymerized with the monomer of the present invention has an acid radical, the ratio of the comonomer with an acid radical in the copolymer is 20 mol % or less, preferably 10 mol % or less, and most preferably 0 in terms of a storage stability of an image.

The monomer of the present invention to be used in the polymer is preferably a methacrylate-based, acrylamide-based, or methacrylamide-based monomer. The monomer is most preferably an acrylamide-based or methacrylamide-based monomer.

The number-average molecular weight of the polymer usable in the present invention is preferably 5,000 or more and 150,000 or less, and more preferably 10,000 or more and 100,000 or less.

The water-insoluble polymer of the present invention is a polymer having a solubility of 3 g or less, and preferably 1 g or less in 100 g of distilled water (25° C.).

Specific examples of the polymer for use in the present invention will be presented below, but the present invention is not limited to these examples. The copolymerization ratio of each copolymer in the following specific examples is represented in terms of a molar ratio.

P-1 Polymethylmethacrylate
P-2 Polyethylmethacrylate
P-3 Polyisopropylmethacrylate
P-4 Polymethylchloroacrylate
P-5 Poly(2-tert-butylphenylacrylate)
P-6 Poly(4-tert-butylphenylacrylate)
P-7 Ethylmethacrylate-n-butylacrylate copolymer (70:30)
P-8 Methylmethacrylate-acrylnitrile copolymer (65:35)
P-9 Methylmethacrylate-styrene copolymer (90:10)
P-10 N-tert-butylmethacrylamide-methylmethacrylateacrylic acid copolymer (60:30:10)
P-11 Methylmethacrylate-styrene-vinylsulfonamide copolymer (70:20:10)
P-12 Methylmethacrylate-cyclohexylmethacrylate copolymer (50:50)
P-13 Methylmethacrylate-acrylic acid copolymer (95:5)
P-14 Methylmethacrylate-n-butylacrylate copolymer (65:35)
P-15 Methylmethacrylate-N-vinyl-2-pyrrolidone copolymer (90:10)
P-16 Poly(N-sec-butylacrylamide)
P-17 Poly(N-tert-butylacrylamide)
P-18 Polycyclohexylmethacrylate-methylmethacrylate copolymer (60:40)
P-19 n-butylmethacrylate-methylmethacrylate-acrylamide copolymer (20:70:10)
P-20 Diacetoneacrylamide-methylmethacrylate copolymer (20:80)
P-21 N-tert-butylacrylamide-methylmethacrylate copolymer (40:60)
P-22 Poly(N-n-butylacrylamide)
P-23 tert-butylmethacrylate-N-tert-butylacrylamide copolymer (50:50)
P-24 tert-butylmethacrylate-methylmethacrylate copolymer (70:30)
P-25 Poly(N-tert-butylmethacrylamide)
P-26 N-tert-butylacrylamide-methacrylate copolymer (60:40)
P-27 Methylmethacrylate-acrylonitrile copolymer (70:30)
P-28 Methylmethacrylate-styrene copolymer (75:25)
P-29 Methylmethacrylate-hexylmethacrylate copolymer (70:30)
P-30 Poly(4-biphenylacrylate)
P-31 Poly(2-chlorophenylacrylate)
P-32 Poly(4-chlorophenylacrylate)
P-33 Poly(pentachlorophenylacrylate)
P-34 Poly(4-ethoxycarbonylphenylacrylate)
P-35 Poly(4-methoxycarbonylphenylacrylate)
P-36 Poly(4-cyanophenylacrylate)
P-37 Poly(4-methoxyphenylacrylate)
P-38 Poly(3,5-dimethyladamantylacrylate)
P-39 Poly(3-dimethylaminophenylacrylate)
P-40 Poly(2-naphthylacrylate)
P-41 Poly(phenylacrylate)
P-42 Poly(N,N-dibutylacrylamide)
P-43 Poly(isohexylacrylamide)
P-44 Poly(isooctylacrylamide)

P-45 Poly(N-methyl-N-phenylacrylamide)
P-46 Poly(adamantylmethacrylate)
P-47 Poly(sec-butylmethacrylate)
P-48 Poly(N-tert-butylacrylamide-acrylic acid copolymer (97:3)
P-49 Poly(2-chloroethylmethacrylate)
P-50 Poly(2-cyanoethylmethacrylate)
P-51 Poly(2-cyanomethylphenylmethacrylate)
P-52 Poly(4-cyanophenylmethacrylate)
P-53 Poly(cyclohexylmethacrylate)
P-54 Poly(2-hydroxypropylmethacrylate)
P-55 Poly(4-methoxycarbonylphenylmethacrylate)
P-56 Poly(3,5-dimethyladamantylmethacrylate)
P-57 Poly(phenylmethacrylate)
P-58 Poly(4-butoxycarbonylphenylmethacrylamide)
P-59 Poly(4-carboxyphenylmethacrylamide)
P-60 Poly(4-ethoxycarbonylphenylmethacrylamide)
P-61 Poly(4-methoxycarbonylphenylmethacrylamide)
P-62 Poly(cyclohexylchloroacrylate)
P-63 Poly(ethylchloroacrylate)
P-64 Poly(isobutylchloroacrylate)
P-65 Poly(isopropylchloroacrylate)
P-66 Poly(phenylacrylamide)
P-67 Poly(cyclohexylacrylamide)
P-68 Poly(phenylmethacrylamide)
P-69 Poly(cyclohexylmethacrylamide)
P-70 Poly(butylenadipate)

In the present invention, the amount of the water-insoluble polymer in the silver halide color light-sensitive material is preferably 0.01 to 2.0, and more preferably 0.1 to 1.0, and more preferably 0.2 to 1.0 in a weight ratio with respect to a yellow or cyan coupler contained in light-sensitive layers of the light-sensitive material.

In the present invention, examples of a cyan coupler which are used advantageously in terms of color reproducibility are compounds represented by formulas (IVa) and (IVb) below. An oil-soluble cyan coupler is preferably used as the cyan coupler of the present invention:

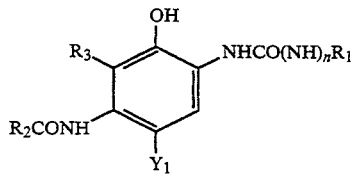

Formula (IV a)

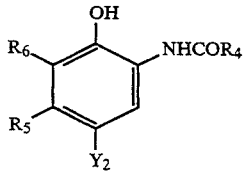

Formula (IV b)

wherein each of $R_1$, $R_2$, and $R_4$ represents a substituted or nonsubstituted aliphatic group, an aromatic group, or a heterocyclic group, and each of $R_3$, $R_5$, and $R_6$ represents a hydrogen atom, a halogen atom, an aliphatic group, an aromatic group, or an acylamino group. $R_3$ together with $R_2$ may represent a nonmetallic atom group for forming a nitrogen-containing 5- or 6-membered ring. Each of $Y_1$ and $Y_2$ represents a hydrogen atom or a group which can split off upon a coupling reaction with the oxidized form of a developing agent. n represents 0 or 1.

In cyan couplers represented by formulas (IVa) and (IVb), preferable examples of an aliphatic group represented by $R_1$, $R_2$, and $R_4$ are methyl, butyl, tridecyl, cyclohexyl, and allyl, each having 1 to 32 carbon atoms, preferable examples of an aryl group represented by $R_1$, $R_2$, and $R_4$ are phenyl and naphthyl, and preferable examples of a heterocyclic group represented by $R_1$, $R_2$, and $R_4$ are 2-pyridyl, 2-imidazolyl, 2-furyl, and 6-quinolyl. These groups may be further substituted with groups selected from alkyl, aryl, a heterocyclic group, alkoxy (e.g., methoxy and 2-methoxyethoxy), aryloxy (e.g., 2,4-di-tert-amylphenoxy, 2-chlorophenoxy, and 4-cyanophenoxy), alkenyloxy (e.g., 2-propenyloxy), acyl (e.g., acetyl and benzoyl), ester (e.g., butoxycarbonyl, phenoxycarbonyl, acetoxy, benzoyloxy, butoxysulfonyl, and toluenesulfonylexy), amido (e.g., acetylamino, methanesulfonamido, and dipropylsulfamoylamino), carbamoyl (e.g., dimethylcarbamoyl and ethylcarbamoyl), sulfamoyl (e.g., butylsulfamoyl), imido (e.g., succinimido and hydantoinyl), ureido (e.g., phenylureido and dimethylureido), an aliphatic or aromatic sulfonyl group (e.g., methanesulfonyl and phenylsulfonyl), an aliphatic or aromatic thio group (e.g., ethylthio and phenylthio), hydroxy, cyano, carboxy, nitro, sulfo, and a halogen atom.

In formula (IVa), if $R_3$ and $R_5$ are substituents which can be substituted, they may be substituted with the substituents enumerated above for $R_1$.

In formula (IVb), $R_5$ is preferably an aliphatic group. Examples of $R_5$ are methyl, ethyl, propyl, butyl, pentadecyl, tert-butyl, cyclohexyl, cyclohexylmethyl, phenylthiomethyl, dodecyloxyphenylthiomethyl, butaneamidemethyl, and methoxymethyl.

In formulas (IVa) and (IVb), each of $Y_1$ and $Y_2$ represents a hydrogen atom or a coupling split-off group (which includes a coupling split-off atom; this will be the same hereinafter). Examples of $Y_1$ and $Y_2$ are a halogen atom (e.g., fluorine, chlorine, and bromine), alkoxy (e.g., ethoxy, dodecyloxy, methoxyethylcarbamoylmethoxy, carboxypropyloxy, and methylsulfonylethoxy), aryloxy (e.g., 4-chlorophenoxy, 4-methoxyphenoxy, and 4-carboxyphenoxy), acyloxy (e.g., acetoxy, tetradecanoyloxy, and benzoyloxy), sulfonyloxy (e.g., methanesulfonyloxy and toluenesulfonyloxy), amido (e.g., dichloroacetylamino, heptafluorobutylamino, methanesulfonylamino, and toluenesulfonylamino), alkoxycarbonyloxy (e.g., ethoxycarbonyloxy, benzyloxycarbonyloxy), aryloxycarbonyloxy (e.g., phenoxycarbonyloxy), aliphatic or aromatic thio (e.g., ethylthio, phenylthio, and tetrazolylthio), imido (e.g., succinimide and hydantoin), and aromatic azo (e.g., phenylazo). These split-off groups may contain photographically useful groups.

In formula (IVa), $R_1$ is preferably an aryl group or a heterocyclic group, and more preferably an aryl group substituted with a halogen atom, alkyl, alkoxy, aryloxy, acylamino, acyl, carbamoyl, sulfonamido, sulfamoyl, sulfonyl, sulfamido, oxycarbonyl, or cyano.

In formula (IVa), preferably $R_3$ and $R_2$ do not form a ring, $R_2$ is preferably substituted or nonsubstituted alkyl or aryl, and most preferably substituted aryloxy-substituted alkyl, and $R_3$ is preferably a hydrogen atom.

In formula (IVb), $R_4$ is preferably substituted or nonsubstituted alkyl or aryl, and more preferably substituted aryloxy-substituted alkyl.

In formula (IVb), $R_5$ is preferably alkyl having 1 to 15 carbon atoms or methyl having a substituent with one or more carbon atoms. Preferable examples of the substituent are arylthio, alkylthio, acylamino, aryloxy, and alkyloxy.

In formula (Ivb), $R_5$ is more preferably alkyl having 1 to 15 carbon atoms, particularly preferably alkyl having 2 to 4 carbon atoms, and most preferably ethyl.

In formula (IVb), $R_6$ is preferably a hydrogen atom or a halogen atom, and most preferably a chlorine atom or a fluorine atom.

In formulas (IVa) and (IVb), each of $Y_1$ and $Y_2$ is preferably a hydrogen atom, a halogen atom, alkoxy, aryloxy, acyloxy, or sulfonamido.

In formula (IVb), $Y_2$ is preferably a halogen atom, and most preferably a chlorine atom or a fluorine atom.

If n=0 in formula (IVa), $Y_1$ is more preferably a halogen atom, and most preferably a chlorine atom or a fluorine atom.

Specific examples of cyan couplers represented by formulas (IVa) and (IVb) of the present invention will be presented below, but the present invention is not limited to these examples.

C-1

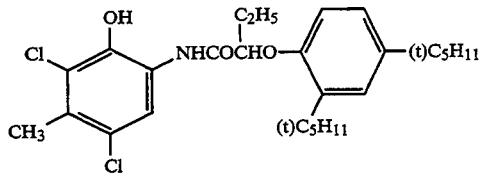

C-2

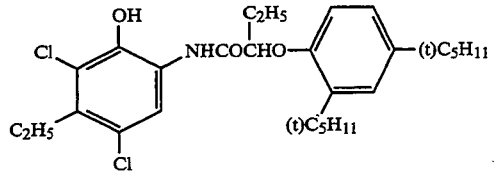

C-3

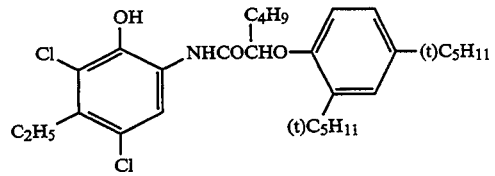

C-4

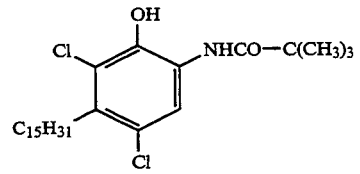

C-5

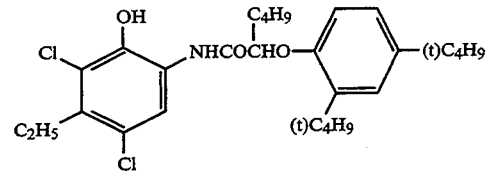

C-6

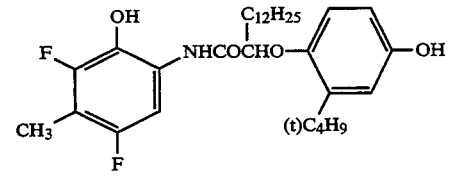

C-7

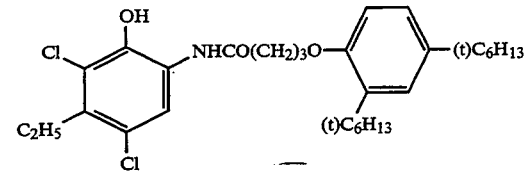

-continued
C-8
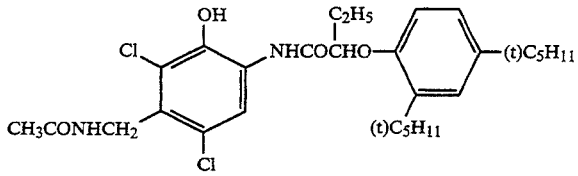
C-9
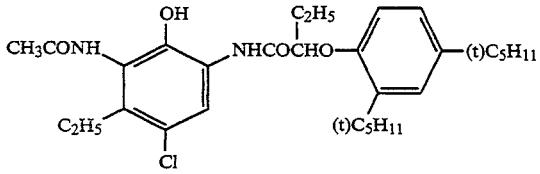
C-10
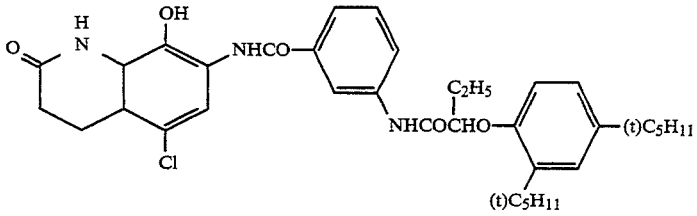
C-11
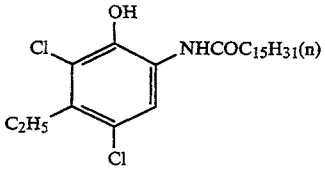
C-12
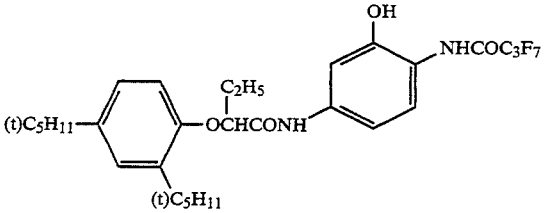
C-13
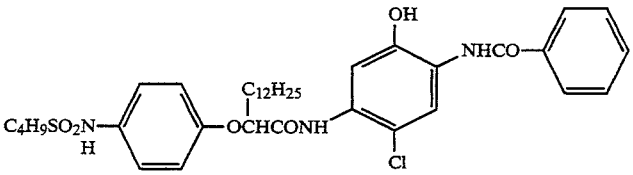
C-14
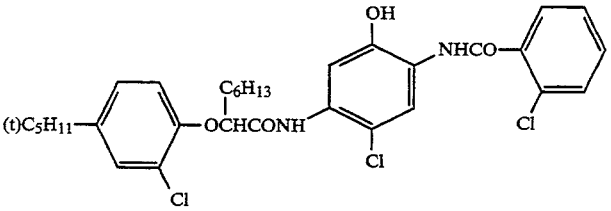
C-15
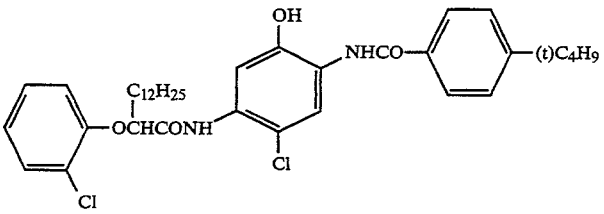

-continued
C-16
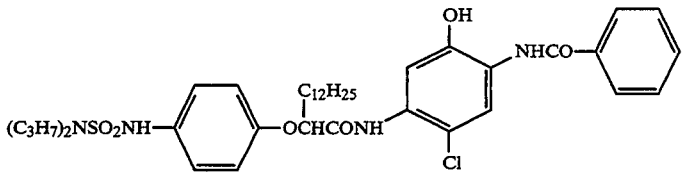
C-17
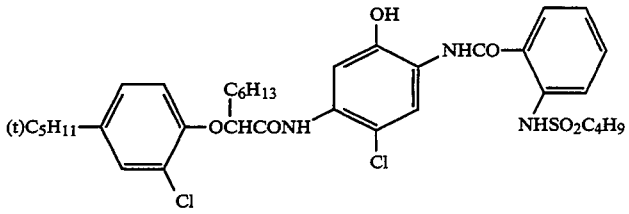
C-18
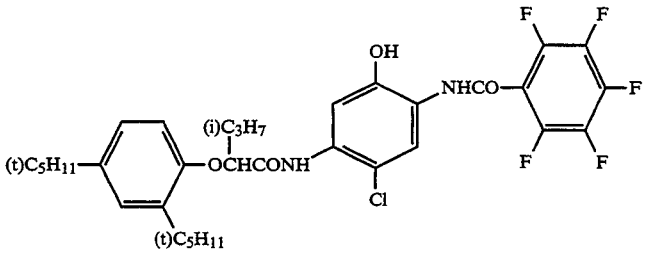
C-19
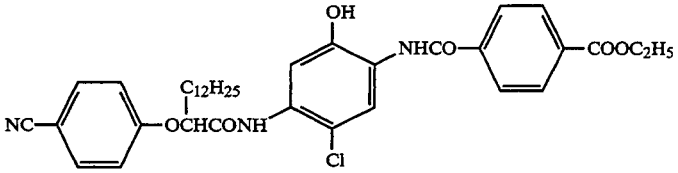
C-20
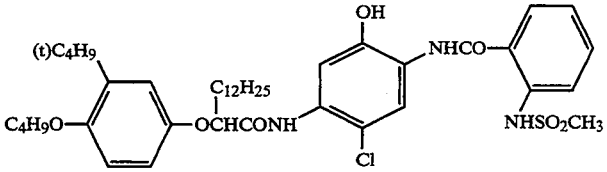
C-21
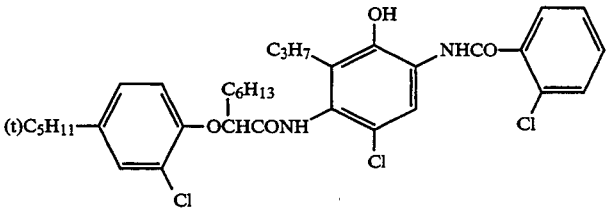
C-22
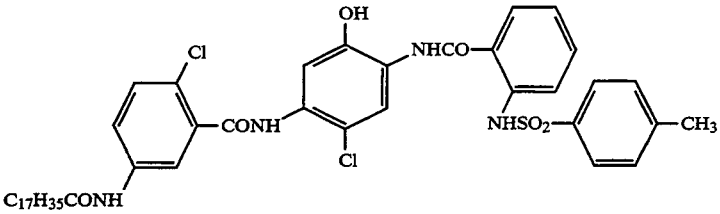

-continued
C-23
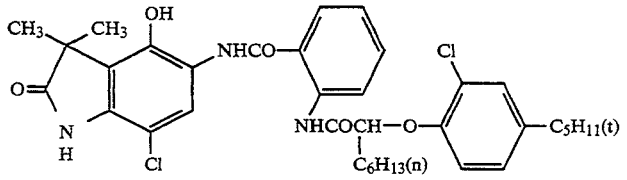
C-24
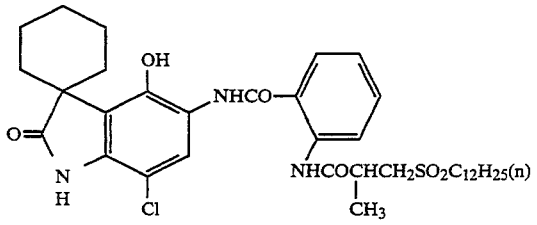
C-25
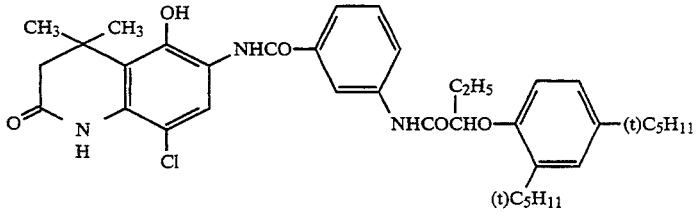
C-26
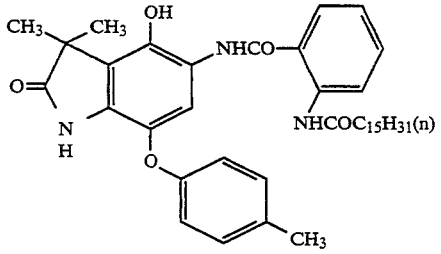
C-27
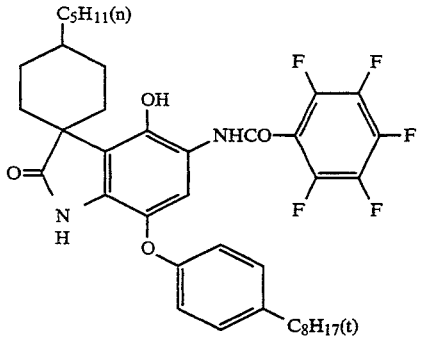
C-28
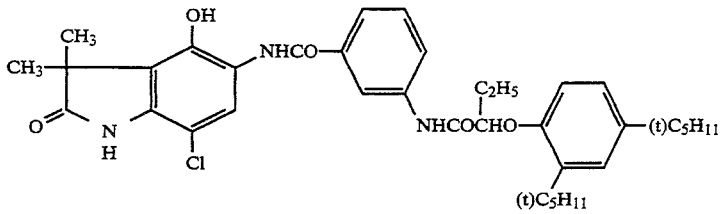

-continued
C-29
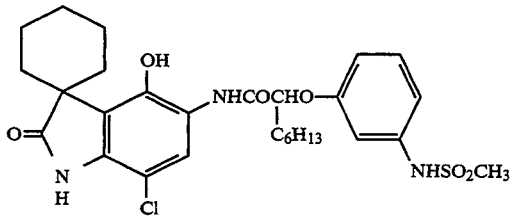
C-30
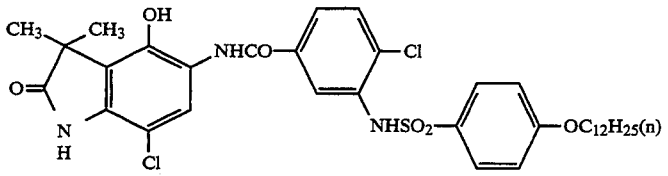
C-31
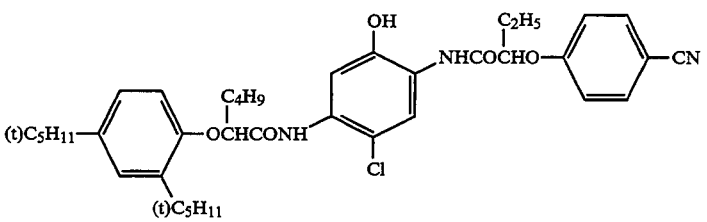
C-32
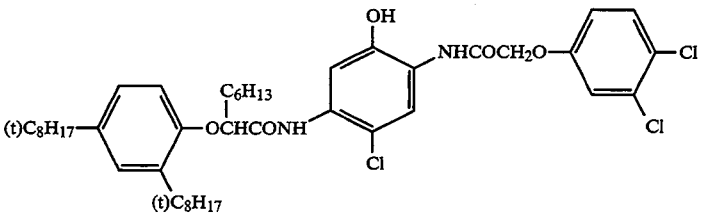
C-33
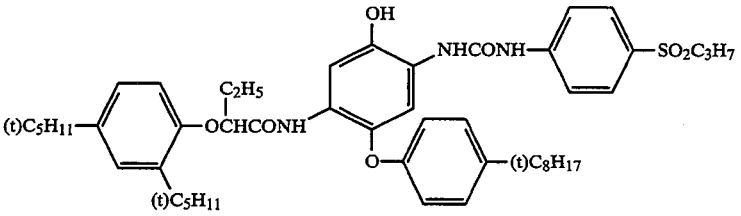
C-34
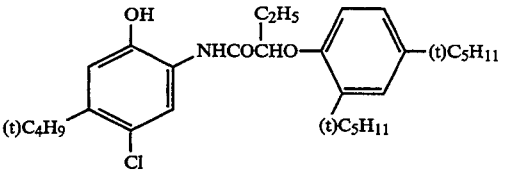
C-35
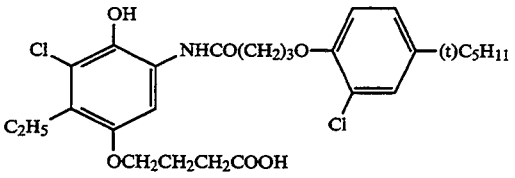

-continued
C-36
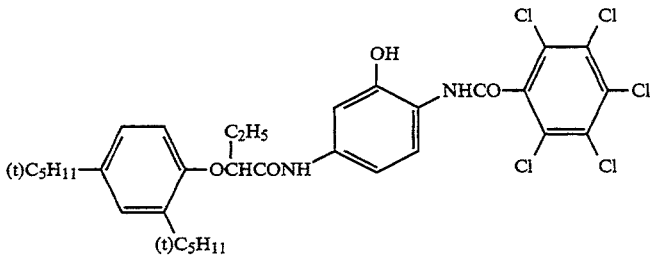
C-37
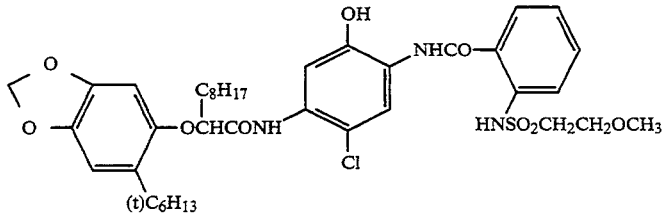
C-38
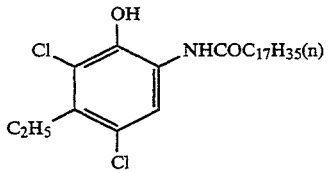
C-39
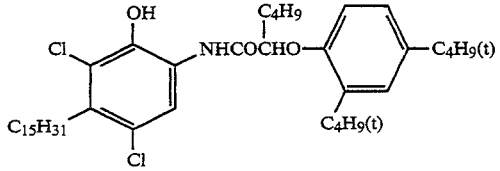
C-40
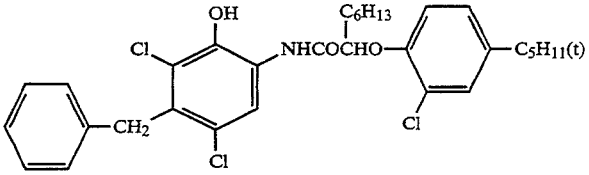
C-41
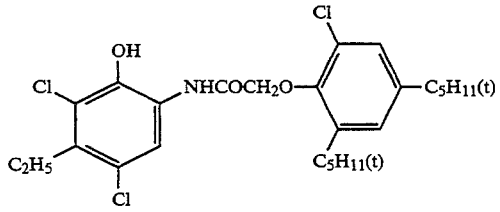
C-42
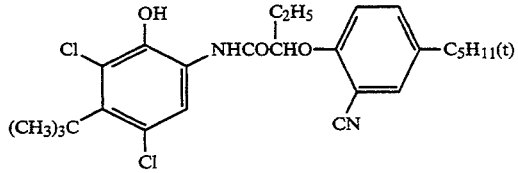
C-43
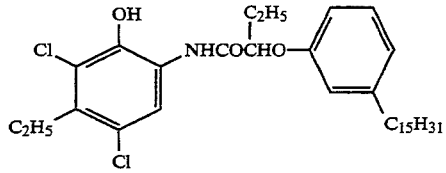

-continued

C-44

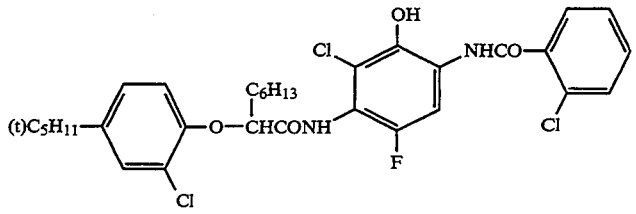

C-45

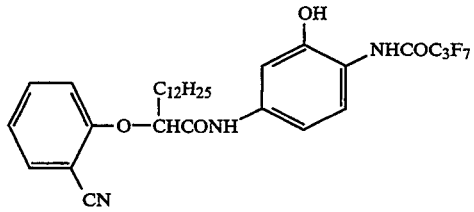

C-46

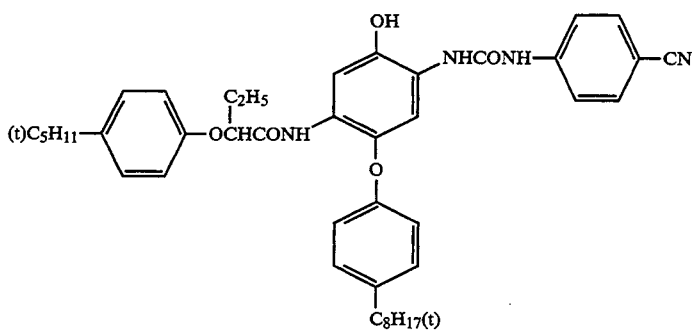

C-47

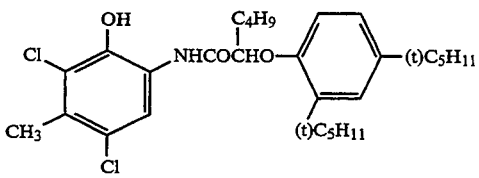

The amount of the cyan coupler of the present invention in the silver halide color light-sensitive material is preferably 0.01 to 5 mmol/$m^2$, and more preferably 0.05 to 2 mmol/$m^2$.

A method of adding the yellow or cyan coupler of the present invention and the water-insoluble polymer to the same layer will be described below.

In the present invention, the coupler and the water-insoluble polymer are preferably finely dispersed together. More preferably, the coupler and the water-insoluble polymer are present in the same oil drop. For example, a so-called loadable latex method (U.S. Pat. No. 4,203,716) can be used to impregnate into a latex of the polymer of the present invention. More preferably, the method described in WO88/00723 and U.S. Pat. No. 5,006,453 can be used. That is, the polymer, the high boiling point coupler solvent, and the coupler of the present invention are completely dissolved into an auxiliary organic solvent. The resultant solution is dispersed in the form of fine particles into water, preferably an aqueous hydrophilic colloid solution, and more preferably an aqueous gelatin solution by using, e.g., an ultrasonic wave or a colloid mill with the aid of a dispersant.

In the silver halide color light-sensitive material of the present invention, yellow and cyan dye forming layers can be arranged at arbitrary positions. In a photographic material, however, the yellow color forming layer is preferably formed on the side closer to incident light.

Examples of a silver halide usable in the present invention are silver chloride, silver bromide, silver (iodo)-chlorobromide, and silver bromoiodide. For the purpose of particularly rapid processing, it is preferable to use a silver chlorobromide or silver chloride emulsion not essentially containing silver iodide and having a silver chloride content of 90 mol % or more, more preferably 95 mol % or more, and most preferably 98 mol % or more.

In order to improve the sharpness or the like of an image, dyes (particularly, an oxonol-based dye) described in EPO 337,490A2, pages 27 to 76, which can be decolored by treatments, are preferably added to the light-sensitive material according to the present invention such that an optical reflection density at 680 nm of the light-sensitive material is 0.70 or more. For the same purpose, it is also preferable to add 12 wt % or more (more preferably 14 wt % or more) of titanium oxide, which is surface-treated with di- to tetra-hydric alcohols (e.g., trimethylolethane), to a water-resistant resin layer of a support.

In addition, in the light-sensitive material according to the present invention, it is preferable to use, with the coupler, particularly with a pyrazoloazole coupler a dye storage stability improving compound as described in EPO 277,589A2.

That is, it is preferable to use one or both of a compound which chemically combines with an aromatic amine-based developing agent remaining after color development to produce a chemically inactive and essentially colorless compound and/or a compound which chemically combines with the oxidized form of an aromatic amine-based color developing agent remaining after development to produce a chemically inactive and essentially colorless compound. This is preferable in, e.g., preventing formation of stains or other side effects caused by a color dye produced when a color developing agent or the oxidized form of the agent remaining in a film reacts with a coupler during storage after the processing.

In the light-sensitive material according to the present invention, a mildewproofing agent as described in JP-A-63-271247 is preferably added in order to prevent various mildews or bacteria which multiply in a hydrophilic colloid layer to deteriorate an image.

As a support for use in the light-sensitive material according to the present invention, a transparent support such as a polyester-based support (e.g., a polyethyleneterephthalate support) or an acetate-based support (e.g., a triacetylcellulose support) is preferably used. For the purpose of display, it is also preferable to use a white polyester-based support or a support in which a layer containing a white pigment is formed on the side of silver halide emulsion layers. In order to further improve a sharpness, an antihalation layer is preferably formed on a silver halide emulsion coating layer or the back surface of the support. The transmission density of the support is preferably set within the range of 0.35 to 0.8 so that a display can be watched by reflected light or transmitted light.

The light-sensitive material of the present invention may be exposed with visible light or infrared light. The exposure method may be either low-intensity exposure or high-intensity short-time exposure. In the case of particularly the latter method, it is preferable to adopt a laser scanning exposure scheme in which an exposure time per pixel is shorter than $10^{-4}$ sec.

In exposure, a band stop filter described in U.S. Pat. No. 4,880,726 is preferably used. Since color mixing is removed by this filter, a color reproducibility is significantly improved.

The exposed light-sensitive material is preferably subjected to bleach-fixing after color development for the purpose of rapid processing. Especially when the high silver chloride emulsion described above is used, the pH of a bleach-fixing solution is preferably about 6.5 or less, and more preferably about 6 or less in order to accelerate desilvering.

Preferable examples of the silver halide emulsions or other materials (e.g., additives) and photographic constituting layers (e.g., a layer arrangement) applied to the light-sensitive material according to the present invention, and methods and additives applied to process the light-sensitive material are described in patent specifications listed in Table A below, and particularly EPO 355,660A2 (JP-A-2-139544).

TABLE A

| Photographic constituting element | JP-A-62-215272 | JP-A-2-33144 | EPO 355,660A2 |
|---|---|---|---|
| Silver halide emulsion | Line 6, upper right column, page 10 to line 5, lower left column, page 12, and line 4 from the bottom, lower right column, page 12 to line 17, upper left column, page 13 | Line 16, upper right column, page 28 to line 11, lower right column, page 29, and lines 2 to 5, page 30 | Line 53, page 45 to line 3, page 47, and lines 20 to 22, page 47 |
| Silver halide solvent | Lines 6 to 14, lower left column, page 12, and line 3, upper left column, page 13 to last line, lower left column, page 18 | — | — |
| Chemical sensitizer | Line 3 from the bottom, lower left column to line 5 from the bottom, lower right column, page 12, and line 1, lower right column, page 18 to line 9 from the bottom, upper right column, page 22 | Line 12 to last line, lower right column, page 29 | Lines 4 to 9, page 47 |
| Spectral sensitizer (spectral sensitizing method) | Line 8 from the bottom, upper right column, page 22 to last line, page 38 | Lines 1 to 13, upper left column, page 30 | Lines 10 to 15, page 47 |
| Emulsion stabilizer | Line 1, upper left column, page 39 to last line, upper right column, page 72 | Line 14, upper left column to line 11, upper light column page 30 | Lines 16 to 19, page 47 |
| Development accelerator | Line 1, lower left column, page 72 to line 3, upper right column, page 91 | — | — |
| Film hardener | Line 8, upper right column, page 146 to line 4, lower left column, page 155 | — | — |
| Developing agent precursor | Line 5, lower left column, page 155 to line 2, lower right column, page 155 | — | — |
| Development inhibitor releasing compound | Lines 3 to 9, lower right column, page 155 | — | — |
| Support | Line 19, lower right column, page 155 to line 14, upper left column, page 156 | Line 18, upper right column, page 38 to line 3, upper left column, | Line 29, page 66 to line 13, page 67 |

TABLE A-continued

| Photographic constituting element | JP-A-62-215272 | JP-A-2-33144 | EPO 355,660A2 |
|---|---|---|---|
| | | page 39 | |
| Arrangement of light-sensitive material layers | Line 15, upper left column, page 156 to line 14, lower right column, page 156 | Lines 1 to 15, upper right column, page 28 | Lines 41 to 52, page 45 |
| Dye | Line 15, lower right column, page 156 to last line, lower right column, page 184 | Line 12, upper left column to line 7, upper right column, page 38 | Lines 18 to 22, page 66 |
| Color mixing inhibitor | Line 1, upper left column, page 185 to line 3, lower right column, page 184 | Lines 8 to 11, upper right column, page 36 | Line 57, page 64 to line 1, page 65 |
| Gradation adjusting agent | Lines 4 to 8, lower right column, page 188 | — | — |
| Stain inhibitor | Line 9, lower right column, page 188 to line 10, lower right column, page 193 | Last line, upper left column to line 13, lower right column, page 37 | Line 32, page 65 to line 17, page 66 |
| Color couplers (cyan, magenta, and yellow couplers) which can use in combination with the coupler of the present invention | Line 4, upper right column, page 91 to line 6, upper left column, page 121 | Line 14, upper right column, page 3 to last line, upper left column, page 18, and line 6, upper right column, page 30 to line 11, lower right column, page 35 | Lines 15 to 27, page 4, line 30, page 5 to last line, page 28, lines 29 to 31, page 45, and line 23, page 47 to line 50, page 63 |
| Color booster | Line 7, upper left column, page 121 to line 1, upper right column, page 125 | — | — |
| Ultraviolet absorbent | Line 2, upper right column, page 125 to last line, lower left column, page 127 | Line 14, lower right column, page 37 to line 11, upper left column, page 38 | Lines 22 to 31, page 65 |
| Discoloration inhibitor (image stabilizer) | Line 1, lower right column, page 127 to line 8, lower left column, page 137 | Line 12, upper right column, page 36 to line 19, upper left column, page 37 | Line 30, page 4 to line 23, page 5, line 1, page 29 to line 25, page 45, line 33, page 45 to line 40, page 65, and lines 2 to 21, page 65 |
| High and/or low boiling point organic solvents | Line 9, lower left column, page 137 to last line, upper right column, page 144 | Line 14, lower right column, page 35 to line 4 from the bottom, upper left column, page 36 | Lines 1 to 51, page 64 |
| Method of dispersing photographic additives | Line 1, lower left column, page 144 to line 7, upper right column, page 146 | Line 10, lower right column, page 27 to last line, upper left column, page 28, and line 12, lower right column, page 35 to line 7, upper right column, page 36 | Line 51, page 63 to line 56, page 64 |
| Surfactant | Line 1, lower left column, page 201 to last line, upper right column, page 210 | Line 1, upper right column, page 18 to last line, lower right column, page 24, and line 10 from the bottom, lower left column to line 9, lower right column, page 27 | — |
| Fluorine-containing compound (to be used as, e.g., antistatic agent, coating aid, lubricant, and antiadhesion agent) | Line 1, lower left column, page 210 to line 5, lower left column, page 222 | Line 1, upper left column, page 25 to line 9, lower right column, page 27 | — |
| Binder (hydrophilic colloid) | Line 6, lower left column, page 222 to last line, upper left column, page 225 | Lines 8 to 18, upper right column, page 38 | Lines 23 to 38, page 66 |
| Thickening agent | Line 1, upper right column, page 225 to line 2, upper right column, page 227 | — | — |
| Antistatic agent | Line 3, upper right column, page 227 to line 1, upper left column, page 230 | — | — |
| Polymer latex | Line 2, upper left column, page 230 to last line, page 239 | — | — |
| Matting agent | Line 1, upper left column, page 240 to last line, upper right column, page 240 | — | — |
| Photographic processing method | Line 7, upper right column, page 3 to line | Line 4, upper left column, page 39 to | Line 14, page 67 to line 28, |

TABLE A-continued

| Photographic constituting element | JP-A-62-215272 | JP-A-2-33144 | EPO 355,660A2 |
|---|---|---|---|
| (e.g., processing steps or additives) | 5, upper right column, page 10 | last line, upper left column, page 42 | page 69 |

In Table A, a portion cited from JP-A-62-215272 includes the contents amended by the amendment, dated Mar. 16, 1987, described at the end of the publication.

Of the above color couplers, it is also preferable to use, as a yellow coupler, so-called short-wave yellow couplers described in JP-A-63-231451, JP-A-63-123047, JP-A-63-241547, JP-A-1-173499, JP-A-1-213648, and JP-A-1-250944.

As a cyan coupler, in addition to a diphenylimidazole cyan coupler described in JP-A-2-33144, the use of a 3-hydroxypyridine cyan coupler (particularly a two-equivalent polymer obtained by introducing a chlorine split-off group to a 4-equivalent coupler of a coupler (42) enumerated as a practical example, or a coupler (6) or (9) is most preferable) described in EPO 333,185A2, or a cyclic active methylene cyan coupler (particularly couplers 3, 8, and 34 enumerated as practical examples are most preferable) described in JP-A-64-32260 is also preferable.

EXAMPLE 1

After corona discharge processing was performed on the surface of a paper support, both the surfaces of which were laminated with polyethylene, a gelatin under-coating layer containing, e.g., sodium dodecylbenzenesulfonate was formed on the support, and various photographic constituting layers were coated on it, thus manufacturing a multilayered color photographic paper (sample 101) having the following layer arrangement. The coating solutions were prepared as follows.

Preparation of coating solution of layer 5 is described below.

50.0 cc of ethyl acetate and 14.0 g of a solvent (Solv-6) were added to 32.0 g of a cyan coupler (ExC), 3.0 g of a dye image stabilizer (Cpd-2), 2.0 g of a dye image stabilizer (Cpd-4), 18.0 g of a dye image stabilizer (Cpd-6), and 5.0 g of a dye stabilizer (Cpd-8). The resultant solution was added to 500 cc of a 20% aqueous gelatin solution containing 8 cc of sodium dodecylbenzenesulfonate, and the resultant mixture was emulsion-dispersed by an ultrasonic homogenizer, thereby preparing an emulsion dispersion. In addition, a silver chlorobromide emulsion (cubic, a 1:4 (Ag molar ratio) mixture of a large-size emulsion having an average grain size of 0.58 μm and a small-size emulsion having that of 0.45 μm. The variation coefficients of grain size distributions of the large- and small-size emulsions were 0.09 and 0.11, respectively. Each emulsion locally contained 0.6 mol % of AgBr in a portion of the surface of each silver chloride grain) was prepared. The large- and small-size emulsions were added with a red-sensitive sensitizing dye E in amounts of $0.9\times10^{-4}$ mol and $1.1\times10^{-4}$ mol, respectively, per mol of silver. Chemical ripening of this emulsion was done by adding a sulfur sensitizer and a gold sensitizer. The above emulsion dispersion and this red-sensitive silver chlorobromide emulsion were mixed and dissolved to prepare a coating solution of layer 5.

Coating solutions of layers 1 to 4, 6, and 7 were prepared following the same procedures as for the coating solution of layer 5. H-1 and H-2 were used as gelatin hardeners in each layer.

Cpd-10 and Cpd-11 were added to each layer so that their total amounts were 25.0 mg/m$^2$ and 50.0 mg/m$^2$, respectively.

Spectral sensitizing dyes used in the silver chlorobromide emulsions of the blue-, green-, and red-sensitive emulsion layers are presented below.

Blue Sensitive Emulsion Layer

Sensitizing Dye A

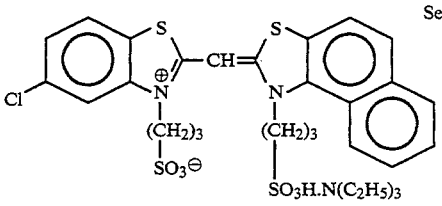

and

Sensitizing Dye B

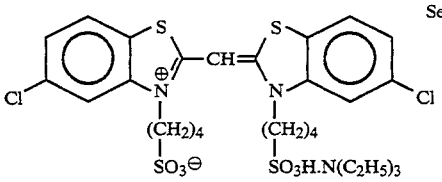

($2.0\times10^{-4}$ mol each for the large-size emulsion and $2.5\times10^{-4}$ mol each for the small-size emulsion per mol of a silver halide)

Green-Sensitive Emulsion Layer

Sensitizing dye C

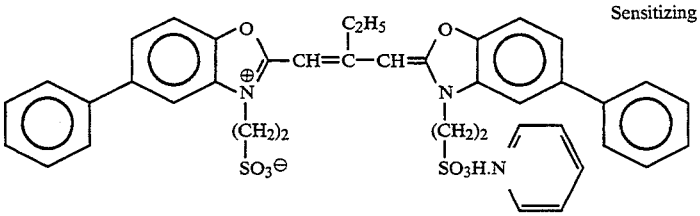

($4.0\times10^{-4}$ mol for the large-size emulsion and $5.6\times10^{-4}$ mol for the small-size emulsion per mol of a silver halide) and Sensitizing dye C

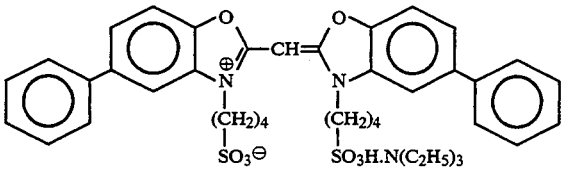

($7.0\times10^{-5}$ mol for the large-size emulsion and $1.0\times10^{-5}$ mol for the small-size emulsion per mol of a silver halide)

Red-Sensitive Emulsion Layer

Sensitizing dye E

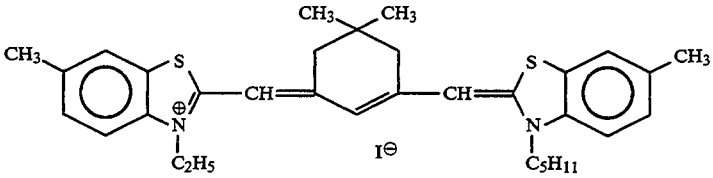

($0.9\times10^{-4}$ mol for the large-size emulsion and $1.1\times10^{-4}$ mol for the small-size emulsion per mol of a silver halide)

In addition, the following compound was added in an amount of $2.6\times10^{-3}$ mol per mol of a silver halide.

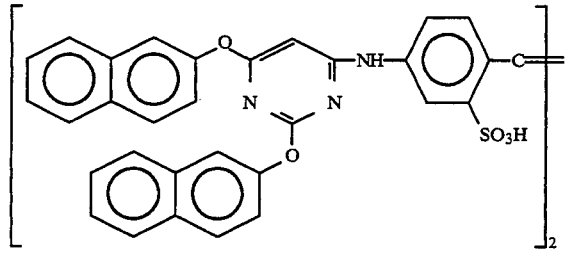

1-(5-methylureidophenyl)-5-mercaptotetrazole was added in amounts of $8.5\times10^{-5}$ mol, $7.7\times10^{-4}$ mol, and $2.5\times10^{-4}$ mol per mol of a silver halide to the blue-, green-, and red-sensitive emulsion layers, respectively. 4-hydroxy-6-methyl-1,3,3a,7-tetraazaindene was added in amounts of $1\times10^{-4}$ mol and $2\times10^{-4}$ mol per mol of a silver halide to the blue- and green-sensitive emulsion layers, respectively.

In addition, the following four types of dyes (numerals in parenthesis represent a coating amount) were added to the emulsion layers in order to prevent irradiation.

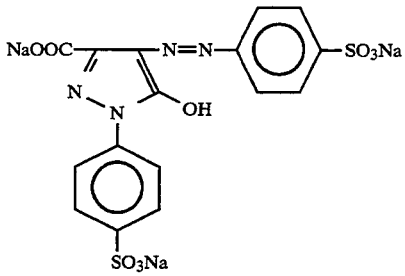

(10 mg/m²)

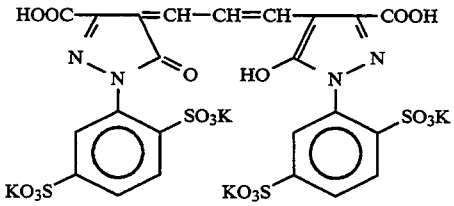

(10 mg/m²)

-continued

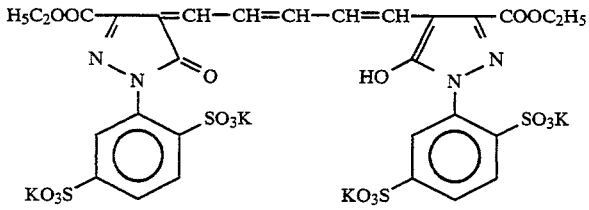

(40 mg/m²)

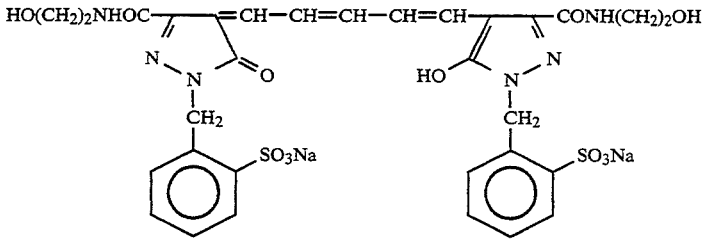

(20 mg/m²)

(Layer Arrangement)

The compositions of the respective layers are described below. The numerals represent a coating amount (g/m²). A silver halide emulsion is represented in terms of a coating amount of silver. The chemical structures or names of compounds used in the respective layers are also presented.

Support

Polyethylene laminated paper (containing a white pigment ($TiO_2$) and a blue dye (ultramarine blue) in polyethylene on the layer 1 side)

| | |
|---|---|
| Layer 1 (blue-sensitive emulsion layer) | |
| Silver bromide emulsion (cubic, a 3:7 mixture (silver molar ratio) of a large-size emulsion having an average grain size of 0.88 μm and a small-size emulsion having that of 0.70 μm. The variation coefficients of grain size distributions of the two emulsions were 0.08 and 0.10, respectively. Each emulsion locally contained 0.3 mol % of silver bromide in a portion of the surface of each grain) | 0.35 |
| Gelatin | 1.86 |
| Yellow coupler ExY(A) | 0.64 |
| Dye image stabilizer (Cpd-1) | 0.19 |
| Solvent (Solv-3) | 0.15 |
| Solvent (Solv-7) | 0.15 |
| Dye image stabilizer (Cpd-9) | 0.04 |
| Stabilizer (Cpd-12) | 0.01 |
| Layer 2 (Color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Layer 3 (Green-sensitive emulsion layer) | |
| Silver chlorobromide emulsion (cubic, a 1:3 mixture (Ag molar ratio) of a large-size emulsion having an average grain size of 0.55 μm and a small-size emulsion having that of 0.39 μm. The variation coefficients of grain size distributions of the two emulsions were 0.10 and 0.08, respectively. Each emulsion locally contained 0.8 mol % of AgBr in a portion of the surface of each grain) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.15 |
| Dye image stabilizer (Cpd-4) | 0.02 |
| Dye image stabilizer (Cpd-9) | 0.02 |
| Solvent (Solv-2) | 0.40 |
| Layer 4 (Ultraviolet absorbing layer) | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Layer 5 (Red-sensitive emulsion layer) | |
| Silver chlorobromide emulsion (cubic, a 1:4 mixture (Ag molar ratio) of a large-size emulsion having an average grain size of 0.58 μm and a small-size emulsion having that of 0.45 μm. The variation coefficients of grain size distributions of the two emulsions were 0.09 and 0.11, respectively. Each emulsion locally contained 0.6 mol % of AgBr in a portion of the surface of each grain) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-8) | 0.05 |
| Solvent (Solv-6) | 0.14 |
| Layer 6 (Ultraviolet absorbing layer) | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| Layer 7 (Protective layer) | |
| Gelatin | 1.33 |
| Acryl-modified copolymer (modification degree = 17%) of polyvinylalcohol | 0.17 |
| Liquid paraffin | 0.03 |

ExY(A) yellow coupler

-continued
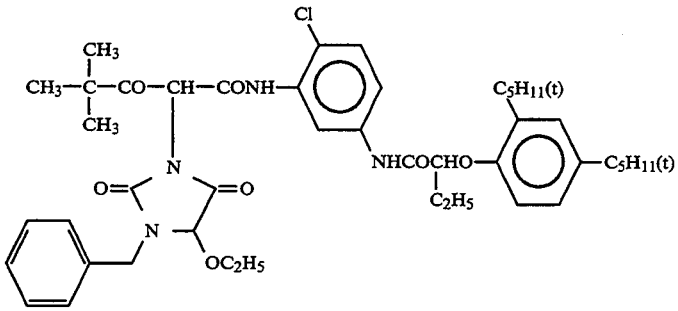
ExY(B) yellow coupler
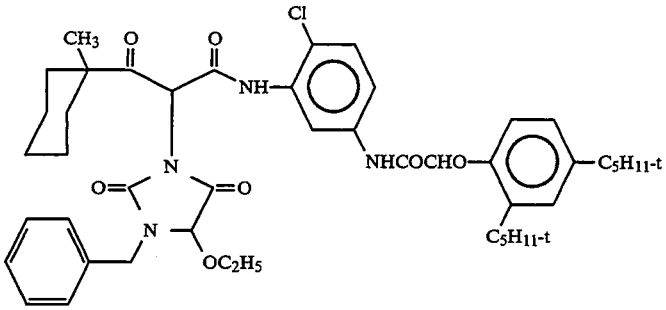
(ExM) mazenta coupler
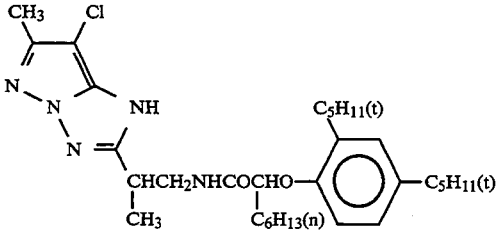
(ExC) cyan coupler
1:1 mixture (mole ratio) of
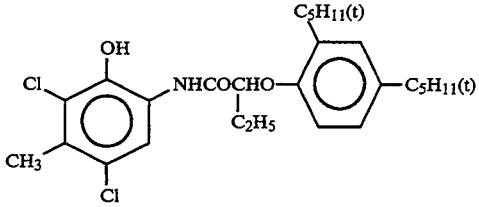
and
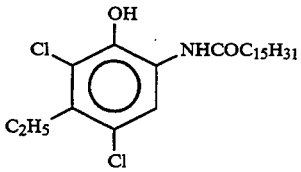
(Cpd-1) dye image stabilizer
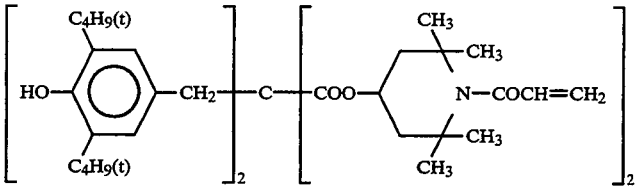
(Cpd-2) dye image stabilizer -continued
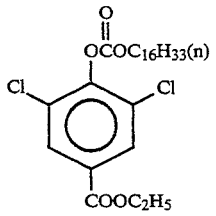
(Cpd-3) dye image stabilizer
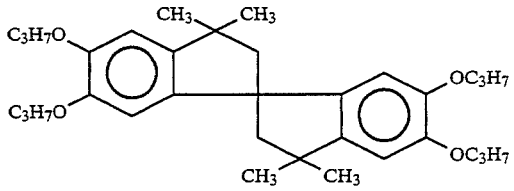
(Cpd-4) dye image stabilizer
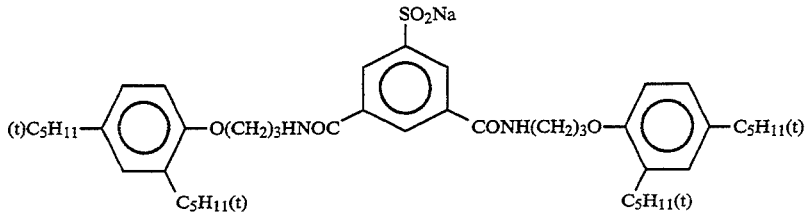
(Cpd-5) color-mixing inhibitor
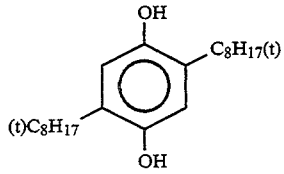
(Cpd-6) dye image stabilizer
2:4:4 mixture (weight ratio) of
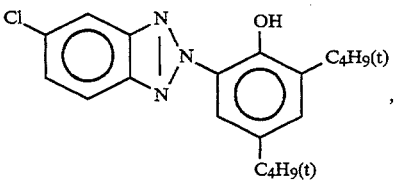
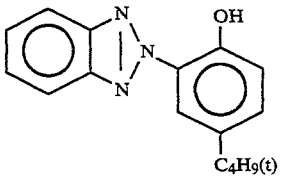
and
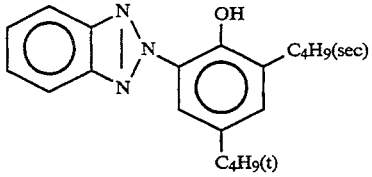
(Cpd-8) dye image stabilizer
1:1 mixture (weight ratio) of -continued
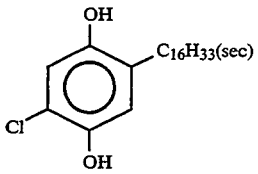
and
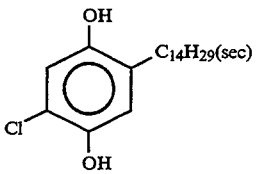
(Cpd-9) dye image stabilizer
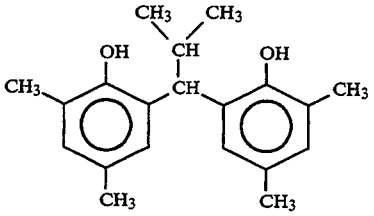
(Cpd-10) antispetics
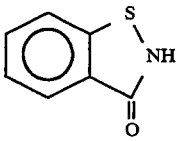
(Cpd-11) antispetics
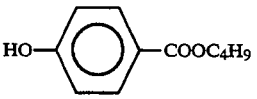
(Cpd-12) stabilizer
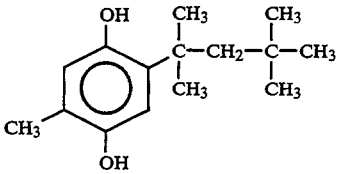
(UV-1) ultraviolet absarbent
4:2:4 mixture (weight ratio) of
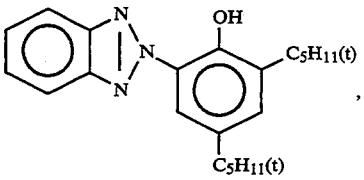
,
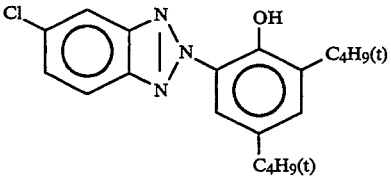
and
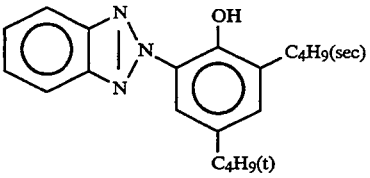
(H-1) film hardner -continued
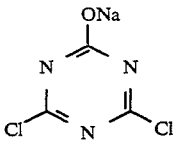
(H-2) film hardner
$CH_2{=}CH{-}SO_2{-}CH_2{-}CONH{-}CH_2$
$\quad\quad\quad described in Tables 1 to 3 was added to the layer 1, the addition amount was set to be 20 wt % of the yellow coupler. When the polymer is added to the layer 5, the addition amount was set to be 50 wt % of the cyan coupler. In this addition of the polymers, the polymer and the coupler was dissolved together in the oil component and then emulsified and dispersed in the layer. In this manner, samples 102 to 138 were formed.

If the couplers used were Y-1, Y-29, Y-41, and Y-42, their coating amounts were set to be 80%, 80%, 90%, and 95%, respectively, without changing the composition of the coating solution of the layer 1.

Samples 101 to 138 were subjected to sensitometry as follows. First, a sensitometer (FWH type available from Fuji Photo Film. Co. Ltd., color temperature of light source=3,200° K.) was used to apply gradation exposure of a sensitometry separation filter to each sample. The exposure in this case was performed with an exposure amount of 250 CMS for an exposure time of 0.1 sec.

By using a paper processor, the exposed samples were subjected to a continuous processing (running test) in accordance with the following processing steps and using processing solutions having the following compositions, until the quantity of a replenisher became twice the tank volume of color development.

| Process | Temperature | Time | Replenisher* | Tank volume |
|---|---|---|---|---|
| Color development | 35° C. | 45 sec. | 161 ml | 17 l |
| Bleach-fixing | 30° C.–35° C. | 45 sec. | 215 ml | 17 l |
| Rinsing 1 | 30° C.–35° C. | 20 sec. | — | 10 l |
| Rinsing 2 | 30° C.–35° C. | 20 sec. | — | 10 l |
| Rinsing 3 | 30° C.–35° C. | 20 sec. | 350 ml | 10 l |
| Drying | 70° C.–80° C. | 60 sec. | | |

*A replenisher is represented in a quantity per 1 $m^2$ of a light-sensitive material. (3-tank counter flow piping from rinsing 1 to 3)

The composition of each processing solution was as follows.

| Color developer | Tank solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfon amidoethyl)-3-methyl-4-amino aniline sulfate | 5.0 g | 7.0 g |
| N,N-bis(carboxymethyl) hydrazine | 4.0 g | 5.0 g |
| N,N-(disulfoethyl) hydroxylamine.1Na | 4.0 g | 5.0 g |
| Fluorescent brightener (WHITEX 4B, available from SUMITOMO CHEMICAL CO. LTD.) | 1.0 g | 2.0 g |
| Water to make | 1,000 ml | 1,000 ml |
| pH (25° C.) | 10.05 | 10.45 |
| Bleach-fixing solution | | (tank solution and replenisher are the same) |
| Water | | 400 ml |
| Ammonium thiosulfate (70%) | | 100 ml |
| Sodium sulfite | | 17 g |
| Ammonium ethylenediamine iron(III) tetraacetate | | 55 g |
| Disodium ethylenediamine tetraacetate | | 5 g |
| Ammonium bromide | | 40 g |

-continued

| Color developer | Tank solution | Replenisher |
|---|---|---|
| Water to make | | 1,000 ml |
| pH (25° C.) | | 6.0 |
| Rinsing solution | | (tank solution and replenisher are the same) |
| Ion exchange water | | (each of calcium and magnesium is 3 ppm or less) |

In a yellow dye formed portion of each processed sample, a maximum yellow dye density $D_B$(max) and a cyan density $D_R$ ($D_B$=2) at a yellow dye density of 2.0 were measured. Note that since a yellow dye density was 2.0 or less in each of samples 105 to 108, a similar measurement was performed in a portion where the color forming density was 1.5.

The results are summarized in Tables 1 to 3. In these tables, symbol * represents a cyan density at a yellow color forming density of 1.5. In addition, present invention (1), (2), and (3) correspond to the inventions described in claims 1, 2, and 3, respectively.

As is apparent from Tables 1 to 3, when comparative coupler is used, it is observed that the density is reduced upon addition of the water-insoluble polymer to the blue-sensitive emulsion layer. In the present invention, however, this density reduction is zero or slight if it is present.

In addition, when the respective comparative couplers are used, a color turbidity $D_R$ ($D_B$=2) represented by a cyan density is slightly increased upon addition of the polymer. However, this color turbidity is obviously decreased when the coupler of the present invention is used. The degree of this reduction is largest when the polymer is added to both of the blue- and red-sensitive emulsion layers. The degree is reduced when the polymer is added to only the blue-sensitive emulsion layer and is further reduced when it is added to only the red-sensitive emulsion layer.

A discoloration test was conducted using the processed samples. That is, a light discoloration test was conducted by radiating light at about 80,000 lux of a xenon fadeometer for 12 days. A heat discoloration test was conducted by storing the samples at a temperature of 80° C. and a relative humidity of 70% for 20 days. In either discoloration test, a reduction in density after the test was measured and represented in units of % assuming that a maximum color forming density before the test was 100%. The results are summarized in Tables 1 to 3.

When the comparative couplers are used, it was observed that both the optical and thermal discolorations were improved upon addition of the water-insoluble polymer. This effect was more significant when the polymer was added to the blue-sensitive emulsion layers. The similar effect was also observed in the couplers of the present invention. This effect of the present invention was obviously superior to that of the comparative coupler. A dye stability of the coupler of the present invention is used is not always excellent. However, the effect is largely improved to a practical level by adding the polymer of the present invention.

As described above, the combination of the acylacetamide-based yellow coupler of the present invention and the water-insoluble polymer makes it possible to provide a silver halide color light-sensitive material having a good color reproducibility and a high stability of dye.

TABLE 1

| No. | Yellow coupler | polymer in Blue-sensitive layer | polymer in Red-senstive layer | $D_B$ (max) | $D_R$ ($D_B = 2$) | Discoloration ratio Light | Heat | Remarks |
|---|---|---|---|---|---|---|---|---|
| 101 | ExY(A) | — | — | 2.43 | 0.19 | 19% | 20% | Comparative Example |
| 102 | " | P-17 | — | 2.21 | 0.21 | 14% | 14% | " |
| 103 | " | — | P-17 | 2.41 | 0.19 | 17% | 19% | " |
| 104 | " | P-17 | P-17 | 2.23 | 0.22 | 13% | 13% | " |
| 105 | ExY(B) | — | — | 1.96 | 0.18* | 17% | 18% | " |
| 106 | " | P-17 | — | 1.55 | 0.19* | 15% | 16% | " |
| 107 | " | — | P-17 | 1.93 | 0.19* | 17% | 18% | " |
| 108 | " | P-17 | P-17 | 1.52 | 0.20* | 14% | 15% | " |
| 109 | Y-1 | — | — | 2.44 | 0.17 | 40% | 27% | " |
| 110 | " | P-17 | — | 2.42 | 0.13 | 19% | 15% | Present Invention (1) |
| 111 | " | — | P-17 | 2.45 | 0.15 | 35% | 25% | Present Invention (2) |
| 112 | " | P-17 | P-17 | 2.40 | 0.11 | 16% | 13% | Present Invention (3) |
| 113 | Y-29 | — | — | 2.38 | 0.16 | 35% | 26% | Comparative Example |
| 114 | " | P-17 | — | 2.36 | 0.12 | 17% | 16% | Present Invention (1) |

TABLE 2

| No. | Yellow coupler | Polymer in Blue-sensitive layer | Polymer in Red-sensitive layer | $D_B$ (max) | $D_R$ ($D_B = 2$) | Discoloration ratio Light | Heat | Remarks |
|---|---|---|---|---|---|---|---|---|
| 115 | Y-29 | — | P-17 | 2.40 | 0.14 | 32% | 24% | Present Invention (2) |
| 116 | " | P-17 | P-17 | 2.35 | 0.10 | 15% | 14% | Present Invention (3) |
| 117 | Y-41 | — | — | 2.39 | 1 0.18 | 48% | 72% | Comparative Example |
| 118 | " | P-17 | — | 2.37 | 0.15 | 29% | 32% | Present Invention (1) |
| 119 | " | — | P-17 | 2.40 | 0.16 | 47% | 69% | Present Invention (2) |
| 120 | " | P-17 | P-17 | 2.36 | 0.13 | 26% | 28% | Present Invention (3) |
| 121 | Y-42 | — | — | 2.42 | 0.19 | 21% | 22% | Comparative Example |
| 122 | " | P-17 | — | 2.34 | 0.17 | 15% | 15% | Present Invention (1) |
| 123 | " | — | P-17 | 2.40 | 0.18 | 20% | 20% | Present Invention (2) |
| 124 | " | P-17 | P-17 | 2.33 | 0.15 | 13% | 14% | Present Invention (3) |
| 125 | Y-1 | P-1 | — | 2.39 | 0.13 | 21% | 16% | Present Invention (1) |
| 126 | " | — | P-1 | 2.40 | 0.15 | 37% | 25% | Present Invention (2) |
| 127 | " | P-1 | P-1 | 2.39 | 0.12 | 17% | 15% | Present Invention (3) |
| 128 | " | P-1 | P-17 | 2.38 | 0.11 | 18% | 17% | Present Invention (3) |

TABLE 3

| No. | Yellow coupler | Polymer in Blue-sensitive layer | Polymer in Red-sensitive layer | $D_B$ (max) | $D_R$ ($D_B = 2$) | Discoloration ratio Light | Heat | Remarks |
|---|---|---|---|---|---|---|---|---|
| 129 | Y-1 | P-53 | — | 2.39 | 0.14 | 20% | 18% | Present Invention (1) |
| 130 | " | — | P-53 | 2.412 | 0.16 | 35% | 24% | Present Invention (2) |
| 131 | " | P-53 | P-53 | 2.40 | 0.12 | 18% | 19% | Present Invention (3) |
| 132 | " | P-53 | P-17 | 2.39 | 0.11 | 16% | 20% | Present Invention (3) |
| 133 | " | P-18 | P-17 | 2.42 | 0.12 | 18% | 18% | Present Invention (3) |
| 134 | " | P-68 | P-17 | 2.38 | 0.10 | 19% | 21% | Present Invention (3) |
| 135 | Y-29 | P-53 | — | 2.39 | 0.13 | 18% | 18% | Present Invention (1) |
| 136 | " | P-53 | P-68 | 2.37 | 0.11 | 16% | 14% | Present Invention (3) |
| 137 | " | P-53 | P-1 | 2.38 | 0.10 | 15% | 16% | Present Invention (3) |
| 138 | " | P-53 | P-17 | 2.37 | 0.11 | 17% | 16% | Present Invention (3) |

EXAMPLE 2

In the color photographic light-sensitive material according to Example 2 described in JP-A-1-158431, the yellow couplers in the layers 11 and 12 are replaced with the couplers Y-1, Y-29, Y-41, and Y-42 of the present invention in coating amounts of 80 mol %, 80 mol %, 90 mol %, and 95 mol %, respectively, and the coating amounts of silver halides are also changed to the above ratios, thereby forming samples of Example 2 of the present invention. Another sample is formed by adding the water-insoluble polymer P-17 to the layers 11 and 12 in an amount of 20 mol % with respect to the yellow couplers.

The above samples are exposed and developed following the same procedures as described in JP-A-1-158431 and evaluated by the method described in Example 1 of the present invention. Also in this Example 2, almost the same effects as in Example 1 could be obtained.

EXAMPLE 3

After corona discharge processing was performed on the surface of a paper support, both the surfaces of which were laminated with polyethylene, a gelatin undercoating layer containing, e.g., sodium dodecylbenzenesulfonate was formed on the support, and various photographic constituting layers were coated on it, thus manufacturing a multilayered color photographic paper (sample 301) having the following layer arrangement. The coating solutions were prepared as follows. Preparation of coating solution of layer 1 is described below.

118.0 g of a yellow coupler (ExY), 7.5 g of a dye image stabilizer (Cpd-2), 16.0 g of a dye image stabilizer (Cpd-3) are dissolved in 25 g of solvent (Solv-1), 25 g of solvent (Solv-2) and 50.0 cc of ethyl acetate. The resultant solution was added to 1000 g of a 10% aqueous gelatin solution containing 60 cc of sodium dodecylbenzenesulfonate and 10 g of citric acid, and the resultant mixture was emulsion-dispersed by an ultrasonic homogenizer, thereby preparing an emulsion dispersion A. In addition, a silver chlorobromide emulsion A (cubic, a 3:7 (Ag molar ratio) mixture of a large-size emulsion A having an average grain size of 0.88 μm and a small-size emulsion B having that of 0.70 μm. The variation coefficients of grain size distributions of the large- and small-size emulsions were 0.08 and 0.10, respectively. Each emulsion locally contained 0.3 mol % of AgBr in a portion of the surface of each silver chloride grain) was prepared. The large- and small-size emulsions were added with a blue-sensitive sensitizing dye A and B in amounts of $2.0\times10^{-4}$ mol and $2.5\times10^{-4}$ mol, respectively, per mol of silver. Chemical ripening of this emulsion was done by adding a sulfur sensitizer and a gold sensitizer. The above emulsion dispersion A and this silver chlorobromide emulsion A were mixed and dissolved to prepare a coating solution of layer 1.

Coating solutions of layers 2 to 7 were prepared following the same procedures as for the coating solution of layer 1. 1-oxy-3,5-dichloro-s-triazine sodium salt were used as gelatin hardeners in each layer.

Cpd-14 and Cpd-15 were added to each layer so that their total amounts were 25.0 mg/m$^2$ and 50.0 mg/m$^2$, respectively.

Spectral sensitizing dyes used in the silver chlorobromide emulsions of the blue-, green-, and red-sensitive emulsion layers are presented below.

Blue Sensitive Emulsion Layer

Sensitizing Dye A

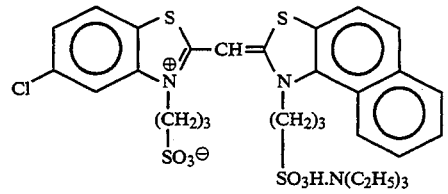

and

Sensitizing Dye B

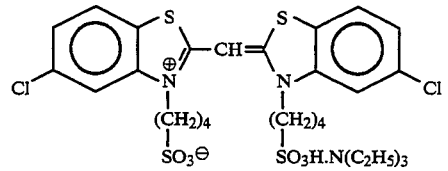

($2.0\times10^{-4}$ mol each for the large-size emulsion and $2.5\times10^{-4}$ mol each for the small-size emulsion per mol of a silver halide)

Green-Sensitive Emulsion Layer

Sensitizing dye C

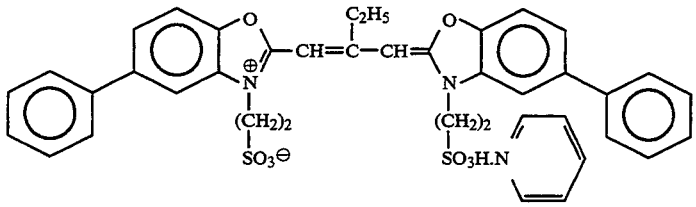

($4.0\times10^{-4}$ mol for the large-size emulsion and $5.6\times10^{-4}$ mol for the small-size emulsion per mol of a silver halide) and sensitizing dye D

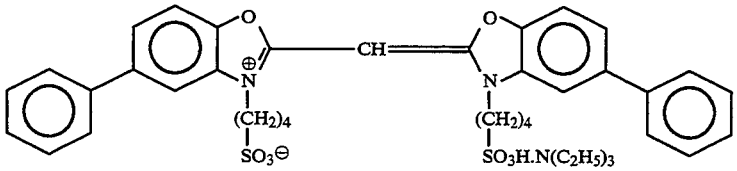

($7.0\times10^{-5}$ mol for the large-size emulsion and $1.0\times10^{-5}$ mol for the small-size emulsion per mol of a silver halide)

Red-Sensitive Emulsion Layer

Sensitizing dye E

-continued

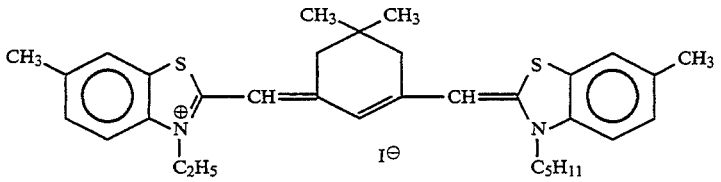

($0.9\times10^{-4}$ mol for the large-size emulsion and $1.1\times10^{-4}$ mol for the small-size emulsion per mol of a silver halide)

In addition, the following compound F was added in an amount of $2.6\times10^{-3}$ mol per mol of a silver halide.

Compound F

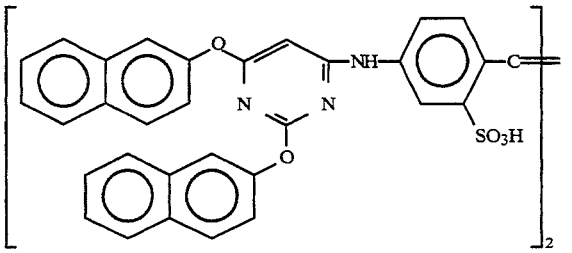

1-(5-methylureidophenyl)-5-mercaptotetrazole was added in amounts of $8.5\times10^{-5}$ mol, $7.7\times10^{-4}$ mol, and $2.5\times10^{-4}$ mol per mol of a silver halide to the blue-, green-, and red-sensitive emulsion layers, respectively.

4-hydroxy-6-methyl-1,3,3a,7-tetraazaindene was added in amounts of $1\times10^{-4}$ mol and $2\times10^{-4}$ mol per mol of a silver halide to the blue- and green-sensitive emulsion layers, respectively.

In addition, the following four types of dyes (numerals in parenthesis represent a coating amount) were added to the emulsion layers in order to prevent irradiation.

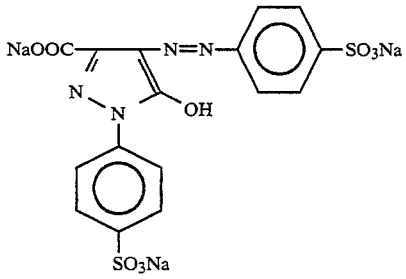

(10 mg/m²)

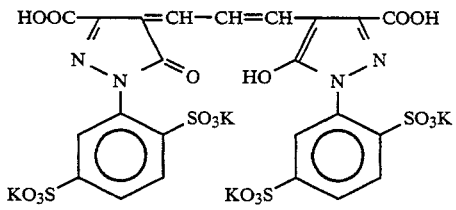

(10 mg/m²)

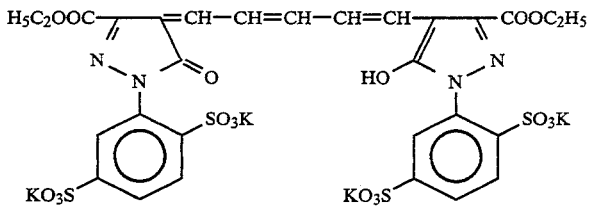

(40 mg/m²)

-continued

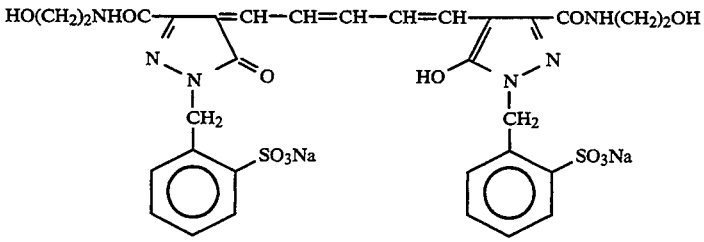

(20 mg/m²)

(Layer arrangement)

The compositions of the respective layers are described below. The numerals represent a coating amount (g/m²). A silver halide emulsion is represented in terms of a coating amount of silver. The chemical structures or names of compounds used in the respective layers are also presented.

Support

Polyethylene laminated paper (containing a white pigment ($TiO_2$) and a blue dye (ultramarine blue) in polyethylene on the layer 1 side)

| | |
|---|---|
| Layer 1 (blue-sensitive emulsion layer) | |
| Silver bromide emulsion described above | 0.27 |
| Gelatin | 1.30 |
| Yellow coupler ExY | 0.61 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Layer 2 (Color mixing inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| Layer 3 (Green-sensitive emulsion layer) | |
| Silver chlorobromide emulsion (cubic, a 1:3 mixture (Ag molar ratio) of a large-size emulsion having an average grain size of 0.55 μm and a small-size emulsion having that of 0.39 μm. The variation coefficients of grain size distributions of the two emulsions were 0.10 and 0.08, respectively. Each emulsion locally contained 0.8 mol % of AgBr in a portion of the surface of each grain) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |

-continued

| | |
|---|---|
| Dye image stabilizer (Cpd-6) | 0.01 |
| Dye image stabilizer (Cpd-7) | 0.01 |
| Dye image stabilizer (Cpd-8) | 0.08 |
| Solvent (Solv-2) | 0.50 |
| Solvent (Solv-4) | 0.15 |
| Solvent (Solv-5) | 0.15 |
| Layer 4 (Color mixing inhibiting) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |
| Layer 5 (Red-sensitive emulsion layer) | |
| Silver chlorobromide emulsion (cubic, a 1:4 mixture (Ag molar ratio) of a large-size emulsion having an average grain size of 0.50 μm and a small-size emulsion having that of 0.41 μm. The variation coefficients of grain size distributions of the two emulsions were 0.09 and 0.11, respectively. Each emulsion locally contained 0.8 mol % of AgBr in a portion of the surface of each grain) | 0.20 |
| Gelatin | 0.85 |
| Cyan coupler (ExC) | 0.33 |
| Ultraviolet absorbent (UV-2) | 0.18 |
| Dye image stabilizer (Cpd-1) | 0.30 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Layer 6 (Ultraviolet absorbing layer) | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| Layer 7 (Protective layer) | |
| Gelatin | 1.13 |
| Acryl-modified copolymer (modification degree = 17%) of polyvinylalcohol | 0.05 |
| Liquid paraffin | 0.02 |
| Dye image stabilizer (Cpd-13) | 0.01 |

(ExY) yellow coupler
1:1 mixture (mole ratio) of

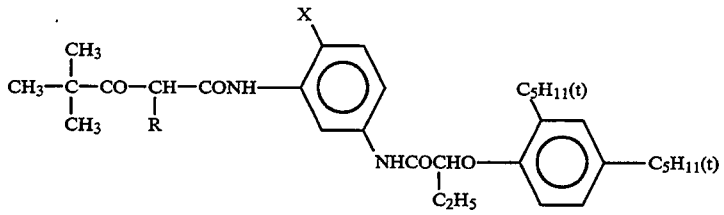

-continued
R = 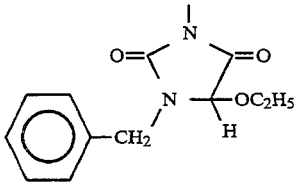 X = Cl
and
R = 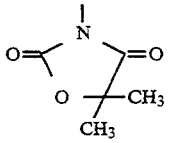 X = $OCH_3$
(ExM) mazenta coupler
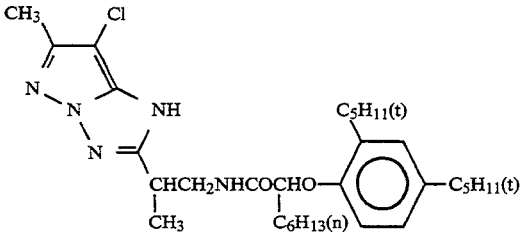
(ExC) cyan coupler
3:7 mixture (mole ratio) of
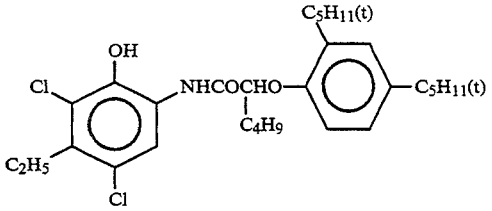
and
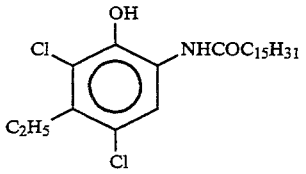
(Cpd-1) dye image stabilizer
$$\left(CH_2-\underset{\substack{|\\ CONHC_4H_9(t)}}{CH}\right)_n$$
number average molecular weight 60,000
(Cpd-2) dye image stabilizer
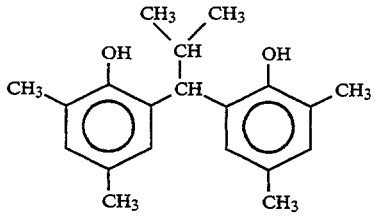
(Cpd-3) dye image stabilizer -continued
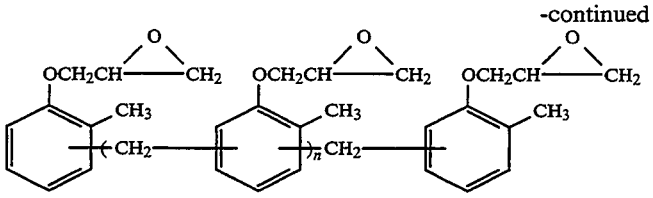
n = 7 to 8 (average)
(Cpd-4) color mixing inhibitor
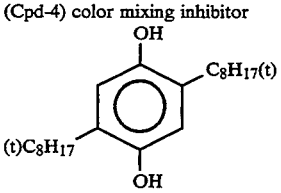
(Cpd-5) dye image stabilizer
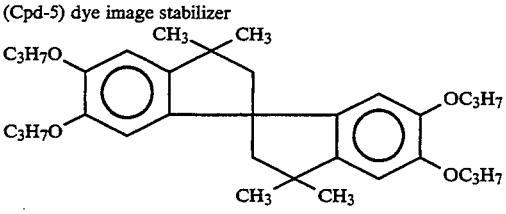
(Cpd-6)
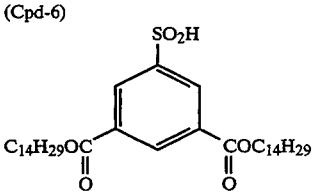
(Cpd-7)
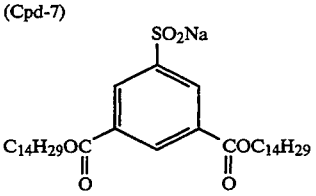
(Cpd-8) dye image stabilizer
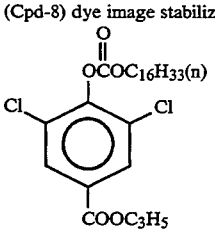
(Cpd-9) dye image stabilizer
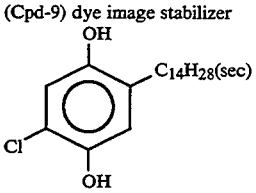
(Cpd-10) dye image stabilizer
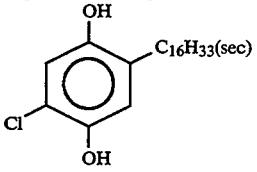

-continued
(Cpd-11)
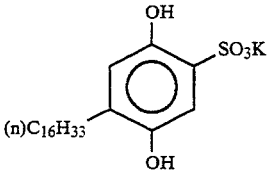
(Cpd-12)
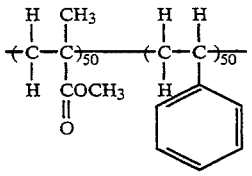
number average molecular weight 60,000
(Cpd-13)
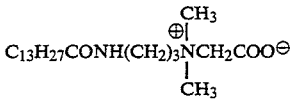
(Cpd-14) antispetics
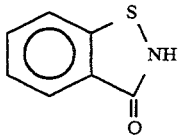
(Cpd-15) antispetics
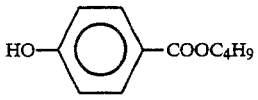
(UV-1) ultraviolet absorbent
10:5:1:5 mixture (weight ratio) of
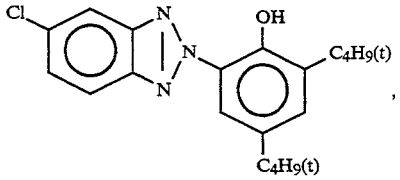
,
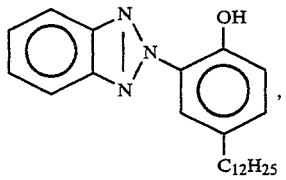
,
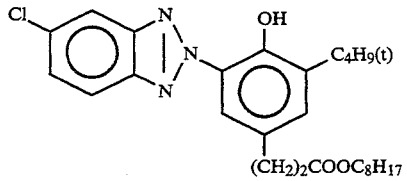
and -continued
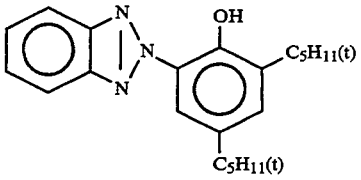
(UV-2) ultraviolet absorbent
1:2:2 mixture (weight ratio) of
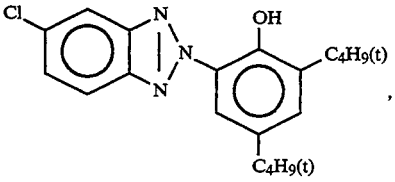
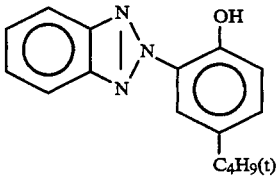
and
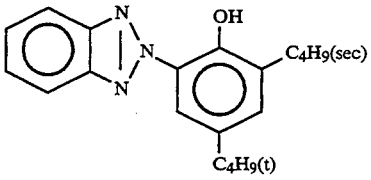
(Solv-1) solvent
$C_8H_{17}\underset{\underset{O}{\vee}}{CHCH}(CH_2)_7COOC_8H_{17}$
(Solv-2) solvent
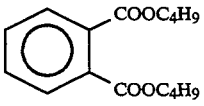
(Solv-3) solvent
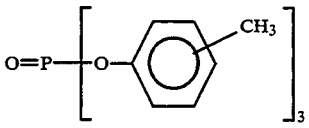
(Solv-4) solvent
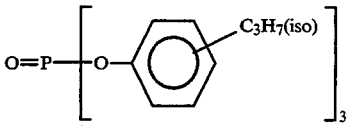
(Solv-5) solvent
$O{=}P{-}(OCH_2\overset{\overset{C_2H_5}{|}}{C}HC_4H_9(n))_3$
(Solv-6) solvent -continued

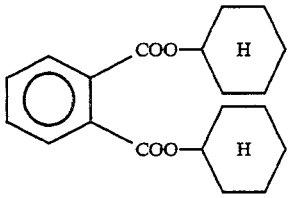

(Solv-7) solvent

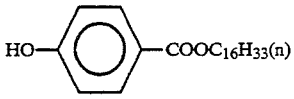

Subsequently, the yellow coupler (ExY) in the layer 1 (blue-sensitive emulsion layer) of the sample 301 was replaced with yellow couplers of the present invention listed in Table 4, and water-insoluble polymer shown in Table 4 were dissolved and emulsion-dispersed together with the couplers in an oil phase and added to the sample, thereby forming samples 302 to 338. Note that when the couplers used were Y-1, Y-43, Y-46, Y-51, and Y-52, the coating amount of the layer 1 was set to be 80% of that of the sample 301 without changing its composition ratio. When the coupler used was Y-59, the coating amount was set to be 95% of that of the sample 301.

First, the sample 301 was subjected to gray exposure by which about 30% of the coating silver amount were developed by using a sensitometer (FWH type available from Fuji Photo Film. Co., Ltd., color temperature of light source=3,200° K.).

By using a paper processor, the exposed sample was subjected to continuous processing in accordance with the following processing steps and using processing solutions having the following compositions, thereby forming a developed state under a running equilibrium condition.

The compositions of the respective processing solutions were as follows.

| Process | Temperature | Time | Replenisher* | Tank volume |
|---|---|---|---|---|
| Color development | 35° C. | 45 sec. | 161 ml | 17 l |
| Bleach-fixing | 30° C.-35° C. | 45 sec. | 215 ml | 17 l |
| Rinsing | 30° C.-35° C. | 20 sec. | — | 10 l |
| Drying | 70° C.-80° C. | 60 sec. | | |

*A replenisher is represented in a quantity per 1 $m^2$ of a light-sensitive material.

The composition of each processing solution was as follows.

| Color developer | Tank solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfon amidoethyl)-3-methyl-4-amino aniline sulfate | 5.0 g | 7.0 g |
| N,N-bis(carboxymethyl) hydrazine | 4.0 g | 5.0 g |
| N,N-(disulfoethyl) hydroxylamine · 1Na | 4.0 g | 5.0 g |
| Fluorescent brightener (WHITEX 4B, available from SUMITOMO CHEMICAL CO. LTD.) | 1.0 g | 2.0 g |
| Water to make | 1,000 ml | 1,000 ml |
| pH (25° C.) | 10.05 | 10.45 |
| **Bleach-fixing solution (tank solution and replenisher are the same)** | | |
| Water | | 400 ml |
| Ammonium thiosulfate (70%) | | 100 ml |
| Sodium sulfite | | 17 g |
| Ammonium ethylenediamine iron(III) tetraacetate | | 55 g |
| Disodium ethylenediamine tetraacetate | | 5 g |
| Ammonium bromide | | 40 g |
| Water to make | | 1,000 ml |
| pH (25° C) | | 6.0 |
| **Rinsing solution (tank solution and replenisher are the same)** | | |
| Ion exchange water (each of calcium and magnesium is 3 ppm or less) | | |

Subsequently, the samples 301 to 338 were exposed by the sensitometer described above by using a sensitometry separation optical wedge, and processed by the processing solutions under the above-mentioned running condition.

The processed samples were evaluated following the same procedures as in Example 1, and the results are summarized in Table 4.

TABLE 4

| No. | Coupler | Polymer Type | Polymer Amount | $D_{max}$ | Discoloration ratio Light | Discoloration ratio Heat | Color turbidity $D_r(D_B = 2)$ | Remarks |
|---|---|---|---|---|---|---|---|---|
| 301 | ExY | — | — | 2.36 | 30% | 35% | 0.19 | Comparative Example |
| 302 | " | P-17 | 10% | 2.25 | 24% | 29% | 0.20 | " |
| 303 | " | " | 20% | 2.02 | 20% | 25% | 0.22 | " |
| 304 | " | " | 50% | 1.53 | 17% | 24% | — | " |
| 305 | " | " | 100% | 1.12 | 15% | 24% | — | " |
| 306 | " | P-53 | 20% | 1.89 | 21% | 28% | — | " |
| 307 | " | P-68 | 20% | 1.94 | 22% | 30% | — | " |

TABLE 4-continued

| No. | Coupler | Polymer Type | Polymer Amount | $D_{max}$ | Discoloration ratio Light | Discoloration ratio Heat | Color turbidity $D_r(D_B = 2)$ | Remarks |
|---|---|---|---|---|---|---|---|---|
| 308 | Y-1 | — | — | 2.42 | 45% | 42% | 0.17 | " |
| 309 | " | P-17 | 10% | 2.41 | 27% | 33% | 0.14 | Present Invention |
| 310 | " | " | 20% | 2.38 | 21% | 27% | 0.13 | " |
| 311 | " | " | 50% | 2.32 | 17% | 24% | 0.14 | " |
| 312 | " | " | 100% | 2.26 | 15% | 23% | 0.14 | " |
| 313 | Y-43 | — | — | 2.40 | 50% | 16% | 0.17 | Comparative Example |
| 314 | Y-43 | P-17 | 10% | 2.40 | 31% | 12% | 0.14 | Present Invention |
| 315 | " | " | 20% | 2.39 | 23% | 10% | 0.13 | " |
| 316 | " | " | 50% | 2.35 | 18% | 8% | 0.13 | " |
| 317 | " | " | 100% | 2.31 | 15% | 8% | 0.14 | " |
| 318 | " | P-53 | 20% | 2.33 | 22% | 11% | 0.14 | " |
| 319 | " | " | 50% | 2.25 | 18% | 10% | 0.15 | " |
| 320 | " | P-68 | 20% | 2.36 | 24% | 12% | 0.14 | " |
| 321 | " | " | 50% | 2.29 | 17% | 10% | 0.15 | " |
| 322 | " | P-21 | 20% | 2.32 | 23% | 11% | 0.15 | " |
| 323 | " | P-26 | " | 2.34 | 23% | 13% | 0.14 | " |
| 324 | " | P-34 | " | 2.27 | 25% | 11% | 0.14 | " |
| 325 | " | P-67 | " | 2.29 | 24% | 12% | 0.15 | " |
| 326 | Y-46 | — | — | 2.38 | 54% | 17% | 0.16 | Comparative Example |
| 327 | " | P-17 | 50% | 2.24 | 19% | 11% | 0.13 | Present Invention |
| 328 | Y-51 | — | — | 2.37 | 52% | 18% | 0.17 | Comparative Example |
| 329 | " | P-17 | 50% | 2.26 | 18% | 10% | 0.14 | Present Invention |
| 330 | Y-52 | — | — | 2.35 | 55% | 18% | 0.17 | Comparative Example |
| 331 | " | P-17 | 50% | 2.21 | 22% | 12% | 0.15 | Present Invention |
| 332 | Y-59 | — | — | 2.35 | 25% | 13% | 0.19 | Comparative Example |
| 333 | " | P-17 | 10% | 2.33 | 18% | 10% | 0.17 | Present Invention |
| 334 | " | " | 20% | 2.30 | 12% | 8% | 0.16 | " |
| 335 | " | " | 50% | 2.21 | 9% | 7% | 0.17 | " |
| 336 | " | " | 100% | 2.08 | 7% | 7% | 0.17 | " |
| 337 | " | P-48 | 20% | 2.35 | 11% | 9% | 0.16 | " |
| 338 | " | " | 50% | 2.30 | 9% | 8% | 0.16 | " |

Note that a heat discoloration test was conducted at a temperature of 80° C. and a relative humidity of 70% for 30 days and a light discoloration test was conducted using a xenon light source of 85,000 lux for 20 days.

As is apparent from Table 4, when the comparative coupler ExY was used, the light discoloration and the dark heat discoloration were improved by the addition of the water-insoluble polymer. This improving effect was enhanced as the addition amount was increased, but the formed dye density was reduced at the same time. This reduction in formed dye density was significant when the addition amount was 20% or more and was serious at an addition amount of 50% or more. Therefore, when a water-insoluble polymer was used together with conventional yellow couplers, a practical addition amount of the polymer was at most 10% to 20%. In addition, an improvement in the cyan color turbidity, which is another object of the present invention, was comparatively deteriorated upon addition of the polymer. Note that the $D_R$ ($D_B$=2) value of each of the samples 304 to 307 is not shown in the table because the maximum color forming density of each sample did not reach 2.0. In each of these samples, however, obvious deterioration in color turbidity was visually confirmed.

When the coupler Y-1 of the present invention was used, on the other hand, improvements in both the light discoloration and the heat discoloration were inferior to those achieved by the comparative coupler ExY if no water-insoluble polymer was added. However, it was found that a greater discoloration improving effect could be obtained by addition of the water-insoluble polymer. This effect was enhanced as the addition amount of the polymer was increased. When the coupler (Y-1) of the present invention was used, a large reduction in formed dye density, as found when the comparative coupler ExY was used, did not occur even if the addition amount of the water-insoluble polymer was increased. Therefore, this coupler can be satisfactorily used even where the use amount of the polymer is large. Especially in a case where the addition amount of the polymer is 20% or more, it is possible to realize a dye stability equal to or better than that obtained over a practical range (polymer addition amount=10% to 20%) of the comparative coupler ExY without causing a large reduction in formed dye density.

When a water-insoluble polymer was added to the coupler (Y-1) of the present invention, a cyan color turbidity was largely improved as indicated by the $D_R$ ($D_B$=2) value. This improving effect is not reduced even if the addition amount of the polymer is 20% or more.

The use of the coupler Y-43, Y-46, Y-51, or Y-52 of the present invention, in which an acyl group is 1-ethylcyclopropanecarbonyl or a 1-propylcyclopropanecarbonyl group, can improve the dye stability without causing a large reduction in formed dye density and can largely improve the cyan color turbidity, through addition of a polymer, as in the case of the coupler (Y-1) of the present invention described above, except that the dark stability is further improved.

The coupler (Y-59) of the present invention is inferior to the above coupler in a reduction in coating amount but has a further improved dye stability. In addition, the coupler (Y-59) is equivalent to the above coupler in the effect of polymer addition.

As described above, it was found that when a water-insoluble polymer was added to the acylacetamide-based yellow coupler of the present invention, it was possible to obtain an improving effect in discoloration greater than any conventionally known effect and to improve a cyan color turbidity. It was also found that a greater improving effect in discoloration could be obtained without causing a large reduction in formed dye density even when the addition amount of the polymer was 20% or more.

What is claimed is:

1. A multilayered silver halide color light-sensitive material having a yellow dye forming silver halide emulsion layer, a magenta dye forming silver halide emulsion layer, and a cyan dye forming silver halide emulsion layer on a support, wherein at least one type of an acylacetamide-based yellow coupler in which the acyl group in the acylacetamide is represented by formula (I) below and at least one type of a water-insoluble polymer are contained in said yellow dye forming layer:

Formula (I)

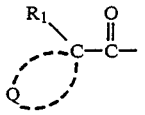

wherein $R_1$ represents a monovalent group, and Q represents a nonmetallic atom group required to form, together with C, a 3- to 5-membered hydrocarbon ring or a 3- to 5-membered heterocyclic ring having at least one hetero atom selected from N, S,O, and P in the ring, $R_1$is not a hydrogen atom and is not combined with Q to form a ring.

2. A multilayered silver halide color light-sensitive material having a yellow dye forming silver halide emulsion layer, a magenta dye forming silver halide emulsion layer, and a cyan dye forming silver halide emulsion layer on a support, wherein at least one type of an acylacetamide-based yellow coupler in which the acyl group in the acylacetamide is represented by formula (I) below is contained in said yellow dye forming silver halide emulsion layer, and at least one type of a water-insoluble polymer is contained in said cyan dye forming silver halide emulsion layer Formula (I)

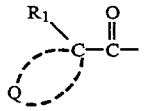

wherein $R_1$ represents a monovalent group, and Q represents a nonmetallic atom group required to form, together with C, a 3- to 5-membered hydrocarbon ring or a 3- to 5-membered heterocyclic ring having at least one hetero atom selected from the group consisting of N, S, O, and P in the ring, $R_1$ is not a hydrogen atom and is not combined with Q to form a ring.

3. The silver halide color light-sensitive material according to claim 1, wherein at least one type of a water-insoluble polymer is contained in said cyan dye forming silver halide emulsion layer.

4. The silver halide color light-sensitive material according to claim 1, wherein the water-insoluble polymer is contained in said yellow dye forming layer at a percentage by weight of 20% or more with respect to the acylacetamide-based yellow coupler in which the acyl group in the acylacetamide is represented by formula (I).

5. The silver halide color light-sensitive material according to claim 1, wherein the acylacetamide based yellow coupler is represented by Formula (Y):

Formula (Y)

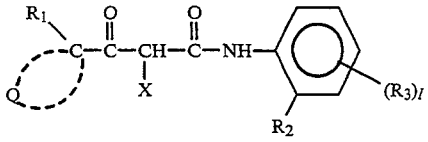

wherein $R_1$ represents a monovalent substituent except for hydrogen,

Q represents a nonmetallic atomic group required to form, together with C, a 3- to 5-membered hydrocarbon ring or a 3- to 5-membered heterocyclic ring containing at least one hetero atom selected from the group consisting of N, S, O, and P in the ring, $R_2$ represents a hydrogen atom, a halogen atom, alkoxy, aryloxy, alkyl, or amino, $R_3$ represents a group substitutable on a benzene ring, X represents a group which can split off upon a coupling reaction with a hydrogen atom or an oxidized form of an aromatic primary amine developing agent, l represents an integer from 0 to 4 and if l represents a plural number, a plurality of $R_3$'s may be the same or different.

6. The silver halide color light-sensitive material according to claim 1, wherein $R_1$ is a hydrocarbon group which may have a substituent.

7. The silver halide color light-sensitive material according to claim 5, wherein $R_3$ is a halogen atom, alkyl, aryl, alkoxy, aryloxy, alkoxycarbonyl, aryloxycarbonyl, carbonamido, sulfonamido, carbamoyl, sulfamoyl, alkylsulfonyl, ureido, sulfamoylamino, alkoxycarbonylamino, alkoxysulfonyl, acyloxy, nitro, a heterocyclic group, cyano, acyl, acyloxy, alkylsulfonyloxy, or arylsulfonyloxy.

8. The silver halide color light-sensitive material according to claim 5, wherein:

$R_1$, $R_2$, $R_3$ or a substituent on the 3- to 5-membered hydrocarbon or heterocyclic ring formed with Q and C of formula (Y) each independently is an alkyl group or contains an alkyl group which is a straight-chain, branched, or cyclic alkyl group which may be substituted and may contain an unsaturated bond;

$R_1$, $R_3$ or a substituent on the 3- to 5-membered hydrocarbon or heterocyclic ring formed with Q and C of formula (Y) each independently is an aryl group or contains an aryl group which is a monocyclic or condensed-ring aryl group; or, Q is a heterocyclic group or contains a heterocyclic group, which is a 3- to 5-membered monocyclic or condensed-ring heterocyclic group which contains at least one hetero atom selected from the group consisting of O, N, S, P, Se and Te in its ring and may be substituted.

9. The silver halide color light-sensitive material according to claim 5, wherein $R_1$ is a halogen atom, a cyano group, or an alkyl or alkoxy group having a total number of carbon atoms of 1 to 30 or an aryl or aryloxy group having a total number of carbon atoms of 6 to 30, each monovalent group of which may be substituted.

10. The silver halide color light-sensitive material according to claim 5, wherein Q represents a non-metallic atom group required to form, together with C, a 3- to 5-membered hydrocarbon ring which has a total number of carbon atoms of 3 to 30, said total number of carbon atoms including a substituent which may be present on the ring or a 3- to 5-membered heterocyclic group which contains at least one hetero atom selected from the group consisting of N, S, O, and P in the ring, has a total number of carbon atoms of 2 to 30, said total number of carbon atoms including a substituent which may be present on the ring, and the ring that Q forms together with C may contain an unsaturated bond therein.

11. The silver halide color light-sensitive material according to claim 5, wherein $R_2$ represents a halogen atom, or an alkoxy having a total number of carbon atoms of 1 to 30, aryloxy having a total number of carbon atoms of 6 to 30, alkyl having a total number of carbon atoms of 1 to 30, or amino having a total number of carbon atoms of 0 to 30, each of which may be substituted.

12. The silver halide color light-sensitive material according to claim 5, wherein $R_3$ represents a halogen atom, or alkyl having a total number of carbon atoms of 1 to 30, aryl having a total number of carbon atoms of 6 to 30, alkoxy having a total number of carbon atoms of 1 to 30, alkoxycarbonyl having a total number of carbon atoms of 2 to 30, aryloxycarbonyl having a total number of carbon atoms of 7 to 30, carbonamido having a total number of carbon atoms of 1 to 30, sulfonamido having a total number of carbon atoms of 1 to 30, carbamoyl having a total number of carbon atoms of 1 to 30, sulfamoyl having a total number of carbon atoms of 0 to 30, alkylsulfonyl having a total number of carbon atoms of 1 to 30, arylsulfonyl having a total number of carbon atoms of 6 to 30, ureido having a total number of carbon atoms of 1 to 30, sulfamoylamino having a total number of carbon atoms of 0 to 30, alkoxycarbonylamino having a total number of carbon atoms of 2 to 30, a heterocyclic group having a total number of carbon atoms of 1 to 30, acyl having a total number of carbon atoms of 1 to 30, alkylsulfonyloxy having a total number of carbon atoms of 1 to 30, or arylsulfonyloxy having a total number of carbon atoms of 6 to 30, each of which may be substituted.

13. The silver halide color light-sensitive material according to claim 5, wherein l represents an integer of 1 or 2.

14. The silver halide color light-sensitive material according to claim 5, wherein the position of $R_3$ on a benzene ring is meta or para with respect to a group represented by formula (Y-a):

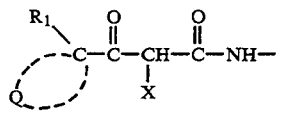

Formula (Y-a)

wherein the substituents are as defined above.

15. The silver halide color light-sensitive material according to claim 5, wherein X represents a heterocyclic group which is bonded to a coupling active position by a nitrogen atom or an aryloxy group.

16. The silver halide color light-sensitive material according to claim 1, wherein the amount of the acylacetamide-based yellow coupler in the silver halide color light-sensitive material is 0.01 to 5 mmol/$m^2$.

17. The silver halide color light-sensitive material according to claim 1, wherein the polymer is a vinyl polymer or a polyester-based polymer, in which a repeating unit has a —(C═O)—bond.

18. The silver halide color light-sensitive material according to claim 1, wherein the number average molecular weight of the polymer is in the range of 5,000–150,000.

19. The silver halide color light-sensitive material according to claim 1, wherein the water-insoluble polymer has a solubility of 3 g or less in 100 g of distilled water (25° C.).

20. The silver halide color light-sensitive material according to claim 1, wherein the amount of polymer in the silver halide color light-sensitive material is 0.01 to 2.0 in a weight ratio with respect to a yellow or a cyan coupler present in the light-sensitive layers of the light-sensitive material.

21. The silver halide color light-sensitive material according to claim 5, wherein:

$R_1$, $R_2$ or $R_3$ each independently is an alkyl group or contains an alkyl group which is a straight-chain, branched, or cyclic alkyl group which may be substituted and may contain an unsaturated bond;

$R_1$ or $R_3$ each independently is an aryl group or contains an aryl group which is a monocyclic or condensed-ring aryl group; or, Q is a heterocyclic group or contains a heterocyclic group, wherein the heterocyclic group is a 3- to 5-membered monocyclic or condensed-ring heterocyclic group which contains at least one hetero atom selected from the group consisting of O, N, S, P, Se and Te in its ring and may be substituted.

* * * * *